US011371297B1

(12) United States Patent
Cree et al.

(10) Patent No.: US 11,371,297 B1
(45) Date of Patent: Jun. 28, 2022

(54) WIRELINE DEPTH MONITORING SYSTEM WITH VALVE LOCKOUT

(71) Applicants: Terry Cree, Weatherford, TX (US); Kyle Craker, Quaker City, OH (US); Logen Kanngiesser, Wheeling, WV (US)

(72) Inventors: Terry Cree, Weatherford, TX (US); Kyle Craker, Quaker City, OH (US); Logen Kanngiesser, Wheeling, WV (US); Avery Simon, Morgantown, WV (US); Edward Gibson, Morgantwon, WV (US)

(73) Assignees: Terry Cree, Weatherford, TX (US); Kyle Craker, Quaker City, OH (US); Logen Kanngiesser, Wheeling, WV (US)

( * ) Notice: Subject to any disclaimer, the term of this patent is extended or adjusted under 35 U.S.C. 154(b) by 203 days.

(21) Appl. No.: 16/785,171

(22) Filed: Feb. 7, 2020

Related U.S. Application Data

(60) Provisional application No. 62/803,461, filed on Feb. 9, 2019.

(51) Int. Cl.

| | |
|---|---|
| ***E21B 19/00*** | (2006.01) |
| ***E21B 34/02*** | (2006.01) |
| ***E21B 47/092*** | (2012.01) |

(52) U.S. Cl.
CPC ..... *E21B 19/00* (2013.01); *E21B 19/008* (2013.01); *E21B 34/02* (2013.01); *E21B 47/092* (2020.05)

(58) Field of Classification Search
CPC ..... E21B 47/09; E21B 19/008; E21B 34/02; E21B 19/00
See application file for complete search history.

(56) References Cited

U.S. PATENT DOCUMENTS

| | | | |
|---|---|---|---|
| 4,368,871 | A | 1/1983 | Young |
| 5,278,549 | A | 1/1994 | Crawford |
| 7,724,989 | B2 | 5/2010 | Kodama et al. |

(Continued)

OTHER PUBLICATIONS

Christmas Tree (Oil Well), Wikibedia, https://en.wikipedia.org/wiki/Christmas_tree_(oil_well), admitted to be prior art, dated prior to the earliest priority date.

(Continued)

*Primary Examiner* — Robert E Fuller
(74) *Attorney, Agent, or Firm* — William F. Lang, IV; Lang Patent Law LLC

(57) ABSTRACT

A depth monitoring and valve lockout automatically resists operation of a valve when a wireline is being used within a well. The system utilizes components which can be attached to presently available wellheads, wireline lubricators, and accumulators without modification. A wellhead unit detects a beacon secured to a wireline lubricator to determine the wellhead for which the lubricator is being used. Proximity sensors detect proximity indicators secured to the wireline reel to detect rotation of the reel. Rotation of the reel is used to determine the presence of wireline within the wellhead having the wireline lubricator. An accumulator unit actuates linear actuators to move the presently existing lockout controls in response to the presence or removal of the wireline.

10 Claims, 20 Drawing Sheets

(56) References Cited

U.S. PATENT DOCUMENTS

| | | | | |
|---|---|---|---|---|
| 8,479,826 | B2 | 7/2013 | Vick, Jr. | |
| 9,376,909 | B2 | 6/2016 | Mathiszik | |
| 9,638,006 | B2 | 5/2017 | Henschel et al. | |
| 2016/0003033 | A1* | 1/2016 | Coles | E21B 33/072 73/152.58 |
| 2017/0152723 | A1 | 6/2017 | Deacon et al. | |
| 2018/0347301 | A1 | 12/2018 | Hilliard et al. | |

OTHER PUBLICATIONS

Digi Xbee-Pro 900 HP, Digi International Inc., 2018.
Hydraulic Fracturing, Wikipedia, https://en.wikipedia.org/wiki/Hydraulic_fracturing, admitted to be prior art, dated prior to the earliest priority date.
Datasheet BL652-SA and BL652-SE, Laird, 2019.
DRV8848 Dual H-Bridge Motor Driver, Texas Instrucments, Nov. 2015.
MSP430Fr599x, MSP430FR596x Mixed Signal Multicontrollers, Texas Instruments, Aug. 2018.
MSP430FR58xx, MSP430FR59xx, and MSP430FR6xx Family User's Guide, Texas Instruments, Dec. 2017.
TPS6213x 3-V to17-V 3-A Step-Down Converter In 3×3 QFN Package, Texas Instruments, Aug. 2016.
Wireline (Cabling), Wikipedia, https://en.wikipedia.org/wiki/Wireline_(cabling), admitted to be prior art, dated prior to the earliest priority date.

* cited by examiner

WIRELINE DEPTH MONITORING SYSTEM WITH VALVE LOCKOUT

CROSS REFERENCE TO RELATED APPLICATION

This application claims the benefit of U.S. provisional patent application Ser. No. 62/803,461, filed Feb. 9, 2019, and entitled "Wireline Depth Monitoring System With Valve Lockout."

TECHNICAL FIELD

The present invention relates to operations conducted within wells utilizing a tool connected to a wireline. More specifically, a depth monitoring and lockout system is provided to avoid inadvertent closure of a valve on a wireline that is within a natural gas, petroleum, or other well.

BACKGROUND INFORMATION

Hydraulic fracturing, which is more commonly known as "fracking," is a process of fracturing rock using a pressurized liquid. Fracking fluid is composed primarily of water, sand, and/or other suspended proppants as well as a thickening agent, all of which are well-known to those skilled in the art. The fracking fluid is injected at high pressure into a wellbore to create cracks in deep rock formations. Natural gas and petroleum can then flow more freely through the cracked rock. When pressure is removed, the sand or other proppants hold the fractures open.

A well typically includes a wellhead, which often includes a "frack stack" or "Christmas tree," which is used to control the flow of gas out of the well, as well as injections into the well. The Christmas tree includes a variety of valves, injection points, monitoring points, and sensors in order to accomplish this purpose. The valves typically include manual and hydraulic master valves, as well as hydraulically operated wing valves for production from the well or injections into the well. The Christmas tree also includes a top valve to which a wireline lubricator can be attached during wireline operations. The wireline lubricator typically includes a pump-in sub to inject fluid into the pressure control string, a grease injector head for reducing well pressure, a pack-off and a line wiper to create a seal around a wireline using hydraulic pressure, a head catcher for retaining a tool at the top of the lubricator section, and a tool trap for preventing a tool from inadvertently falling down the hole. The wireline lubricator also typically includes a blowout preventer, which includes a valve that can be quickly closed to contain high pressure within the well. Blowout preventers are typically designed to include a means of cutting a wireline that may be contained within the blowout preventer during closing of a valve in order to ensure that the valve is in fact closed.

A wireline, for example, an electrical line, slick line, braided line, etc. is used to place a variety of tools and equipment within the well, to recover tools and equipment from the well, to utilize various measuring and testing equipment within the well, perforating and setting plugs in the well bore, etc. In the event that the wireline is cut through closure of a valve, a time-consuming, expensive fishing operation will be needed to recover the tool that was attached to the wireline. Although it is sometimes necessary to close a blowout preventer on the wireline, inadvertent closure of the blowout preventer or other valves can and does occur through operator error.

Some examples of presently available wireline protection device are described below. The entire disclosure of each and every reference described below is expressly incorporated herein by reference.

U.S. Pat. No. 5,278,549 discloses a wireline cycle life counter. The wireline monitor can monitor the location of the end of the wireline to prevent a blowout preventer valve from closing and cutting the wireline, as well as to prevent the wireline from being pulled off of a tool when it reaches the top of the hole. A depth sensor monitors the lower end of the wireline so that a blowout preventer valve will not close on the wireline. The specific type of sensor, or other details of the depth sensor are not discussed. Operatively connecting the depth sensor to some means of closing the blow out preventer valve to automatically prevent closing the valve is mentioned, but no specific means of doing so is disclosed.

U.S. Pat. No. 7,724,989 discloses a borehole equipment position detection system. The blowout preventer is illustrated at the upper end of the board, above the sea bed, for use during a subsea drilling operation. The blowout preventer includes a number of valve means for closing both the borehole and a tubular string passing within the borehole. These include lower pipe rams, metal pipe rams, and upper pipe rams, as well as shear blind rams. The rams are only designed to close around a specific diameter of the drill string, for example, on a five inch pipe section. It is therefore important to know whether or not the rams are opposite a suitable section of the drill string to enable them to close correctly and provide a seal. The shear blind rams are designed so that they can cut through the drill string. A riser adapter bore object sensor is disposed at the upper end of the lower riser package disposed above the blowout preventer. A telescopic joint or object sensor is disposed at the upper end of the inner barrel, which is disposed below the drill floor of the drill rig. Each of these sensors detect the diameter, shape, and orientation of the string which is within the sensor. By monitoring the sequence of measurements provided by each sensor, the section of the drill string which is within the blowout protector can be determined at any given time.

U.S. Pat. No. 4,368,871 discloses a lubricator valve apparatus. The apparatus is intended for use when running wireline tools into an offshore well during a production test of the well. The valve includes a tubular valve body having a ball element with a through bore. The ball element is rotatable between an open and closed position. A bypass passage is opened and closed using a slidable bypass valve sleeve. A movable latch sleeve releasably latches the ball element in either the open or closed position. The valve is operated using hydraulic control lines.

U.S. Pat. No. 8,479,826 disclosures protection of a safety valve in a subterranean well. The safety hail protector is located downstream of the safety valve. When closed, the safety valve protector reduces the flow rate through the safety valve, and prevents displacement of an object through the safety valve protector to the safety valve. The safety valve and safety valve protector include actuators that are connected to a signal line for controlling the actuators.

U.S. Pat. No. 9,376,909 discloses an indicator and method of verifying a tool has reached a portion of a tube. The indicator includes a body configured to be run within a tube from a first portion to a second portion of the tube. A sensor is disposed at the body configured to detect when a tool has reached the body. A signal generator is configured to send notification that the tool has reached the body.

U.S. Pat. No. 9,638,006 discloses a safety system for wells having a cable deployed electronic submersible pump. The system includes the first flapper safety valve assembly, and a second flapper a safety valve assembly. The second flapper safety valve allows the cable for the pub to pass through the second flapper safety valve when the valves in the closed position.

US 2017/0152723 discloses a landing string. The landing string includes an upper tubing section, with the retainer valve and disposed at the bottom of the tubing section. The retainer valve is a ball valve type. A shear sub is disposed below the retainer valve. The shear sub is structured so that it can be cut by actuation of the sheer rams of the blowout preventer. A latch 30 is disposed below the shear sub, for use in parting the landing string at this section. A subsea test tree is disposed below the latch. The subsea test tree includes upper and lower ball valves. All three valves include shearing capability so that a wire or object within the valve can be cut if closing the valve becomes necessary. A slick joint section is located below the subsea test tree, permitting the pipe rams of the blowout preventer to seal against the slick joint. The lower most end of the landing string includes a tubing hanger. The valve control system is reconfigurable between a first configuration in which the retainer valve is operated under a fail-as-is mode, and a second configuration in which the valve is operated under a fail-close mode of operation.

US 2018/0347301 discloses a valve assembly. The valve assembly is an axially movable valve housing in the form of a cartridge that is received within the bore of a tubular member. The valve and cartridge are pivotally connected. Axial movement of the cartridge pivots the valve around the connection to open or close the valve.

Accordingly, there is a need for a system for determining the depth of a wireline within a natural gas well or other well. There is a further need for the system to work with a variety of wells having different numbers and locations of valves. Thus, any sensors or other devices that must be installed on a well for the functioning of the system should be easily installed and maintained, and any information about the specific configuration of a well should be easily entered. There is an additional need for the system to determine whether a wireline passes through a given valve, and to lock out closure of that valve while the wireline is present within that valve unless the lock out is overridden due to an emergency.

SUMMARY

The above needs are met by a lockout system for locking out valves on a wellhead when a wireline is present within a wellhead. The lockout system comprises a beacon structured to be secured to a wireline lubricator. A wellhead unit is structured to be secured to the at least one wellhead. The wellhead unit is structured to detect the beacon when the wellhead unit is secured to the at least one wellhead, the beacon is secured to the wireline lubricator, and the wireline lubricator is secured to the wellhead. The lockout system further includes a wireline unit. The wireline unit is in communication with a sensor that is structured to detect rotation of a reel upon which wireline is wound. The system also includes a controller structured to receive communication from the wellhead unit and wireline unit. The controller has memory containing executable instructions to determine whether wireline is present within the at least one wellhead. The system further has an accumulator unit operatively connected to at least one actuator. The at least one actuator is structured to be operatively connected to a lockout for at least one valve on the at least one wellhead. The accumulator unit has memory containing executable instructions to activate the at least one actuator to move a control for the lockout upon the controller determining that wireline is present within the wellhead or upon the controller determining that wireline is no longer within the wellhead.

These needs are further met by A method of locking out valves on a wellhead. The method comprises providing a beacon secured to a wireline lubricator, providing a wellhead unit secured to the at least one wellhead, providing a wireline unit, providing a sensor in communication with the wireline unit, providing an accumulator unit, and providing at least one actuator operatively connected to the accumulator unit, with the at least one actuator also operatively connected to a lockout control for the valves disposed on the wellhead. The beacon is detected using the wellhead unit when the wireline lubricator is secured to the wellhead. Rotation of a reel upon which wireline is wound is detected by the sensor in communication with the wireline unit. The method continues with determining whether wireline is within a wellhead based on detection of the beacon and rotation of the reel. The at least one actuator is activated to move the lockout control upon determining that wireline is present within the wellhead or upon determining that wireline is no longer within the wellhead.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
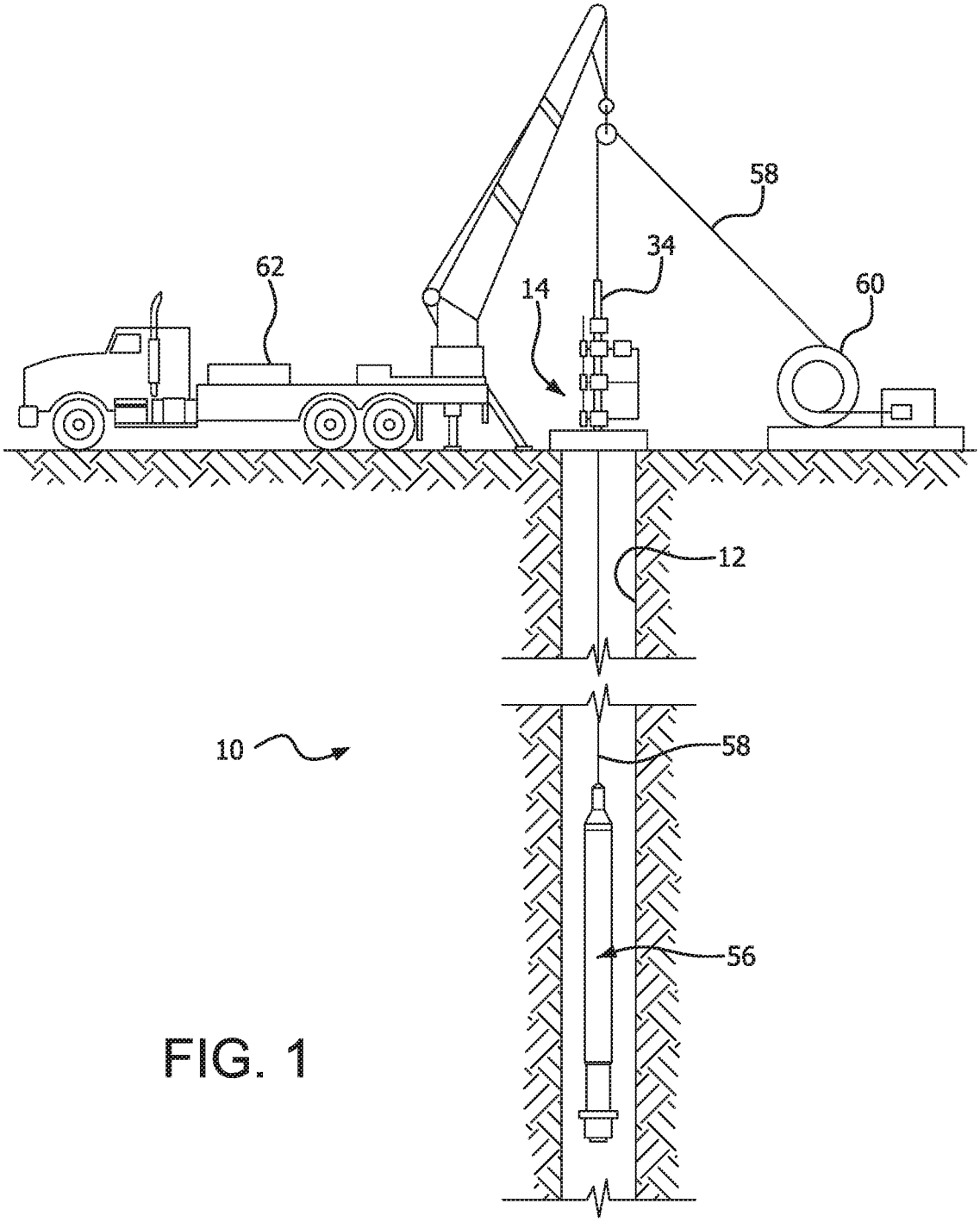
FIG. 1 is a side elevational view showing a wireline being used to position a tool within a well.
Figure 2:
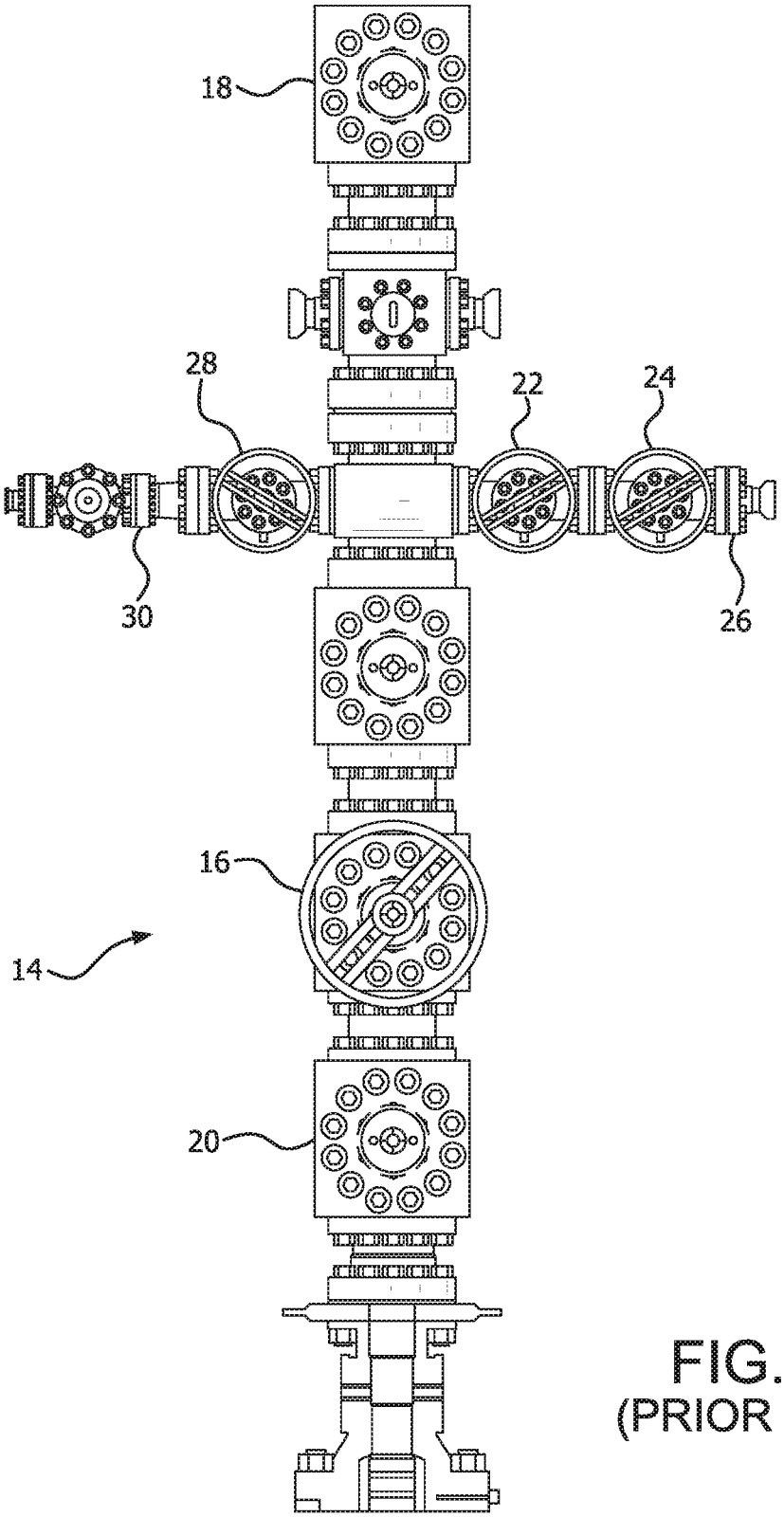
FIG. 2 (PRIOR ART)
FIG. 2 is a side elevational view of a wellhead.

Referring to the drawings, a depth sensor and valve lockout system for wireline operations in wells is illustrated. FIG. 1 illustrates a typical wireline operation. A well 10, which may be a natural gas well, petroleum well, or other type of well, includes a well bore 12 and a wellhead 14. The wellhead 14 includes a plurality of valves, including manual master valve 16 along the main flow path, hydraulic master valves 18, 20 along the main flow path, manual wing valves 22, 24 controlling production through the right wing 26, and hydraulic inlet valve 28 controlling fluid flow into the well through the left wing 30. The top 32 of the wellhead typically includes a provision for mounting a wireline lubricator 34, which is described in greater detail below.

Figure 3:
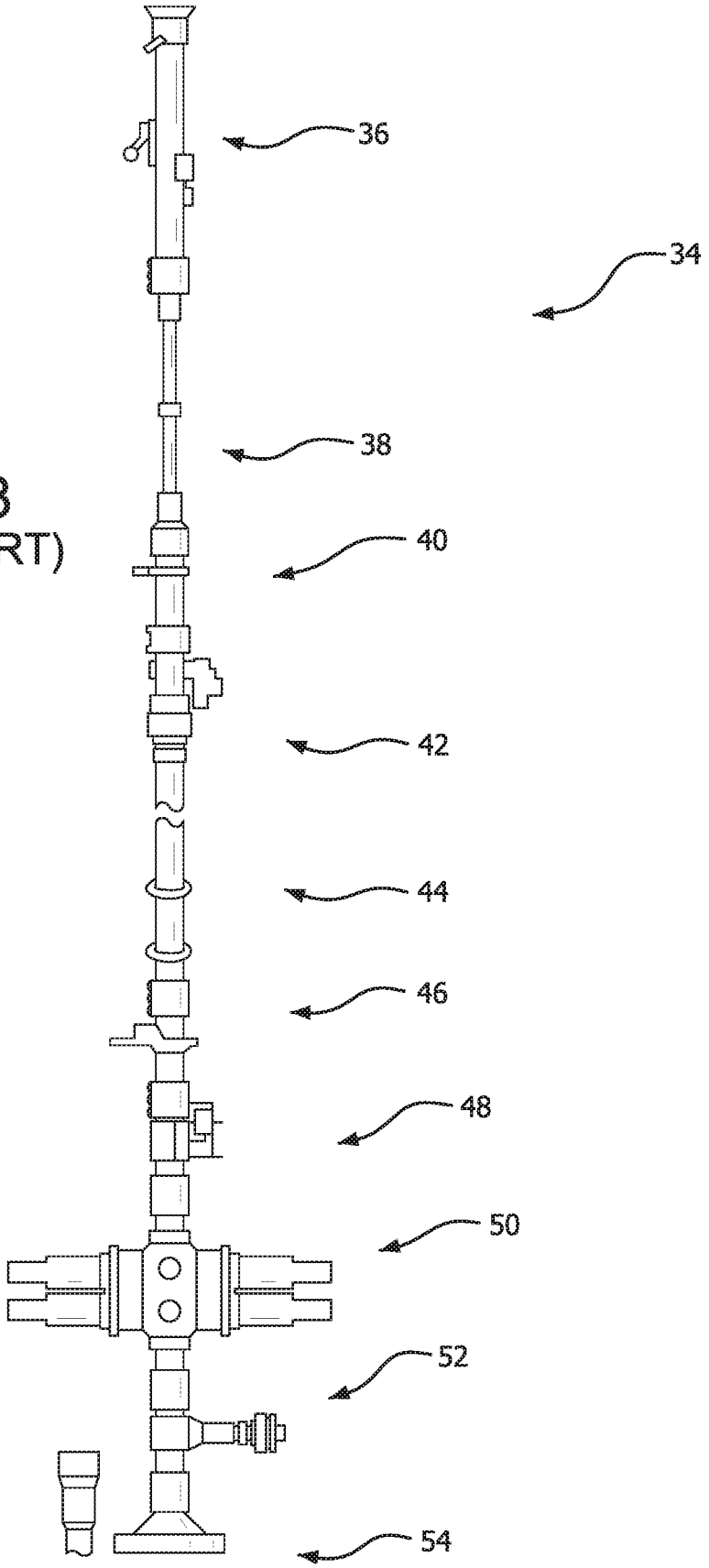
FIG. 3 (PRIOR ART)
FIG. 3 is a side elevational view of a wireline lubricator for a wellhead.

A wireline lubricator 34 is illustrated in FIG. 3. Those skilled in the art of natural gas wells and petroleum wells will recognize that a wireline lubricator is used to seal in wireline tools during pressurization of the well. The wireline lubricator 34 includes a variety of sections, including a line wiper 36, a grease head 38, a head catcher 40, a chemical injection sub 42, a lubricator 44, a quick test sub 46, and a tool trap 48. A blowout preventer 50 is provided to prevent undesired release of fluids in the event of excess pressure within the well. Those skilled in the art will understand that blowout preventers include hydraulic valves that are designed to cut wirelines that may be located within the blowout preventer when closing the blowout preventer becomes necessary. Below the blowout preventer 50 is a pump in sub 52 and an adapter flange 54 for attachment to the wellhead 14.

Referring back to FIG. 1, when a tool, measuring instrument, etc. is lowered into the wellbore 12, the tool 56 is attached to a wireline 58. The wireline 58 is fed from a spool or drum 60 through the wireline lubricator 34, wellhead/frac stack 14, and into the wellbore 12. The spool 60 may in some instances be used in connection with a wireline truck 62. Thus, the wireline 58 passes through a variety of valves in the wireline lubricator 34 as well as the wellhead 14, the closure of any one of which would cause the tool 56 and wireline 58 to fall down the wellbore 12.

Figure 4:
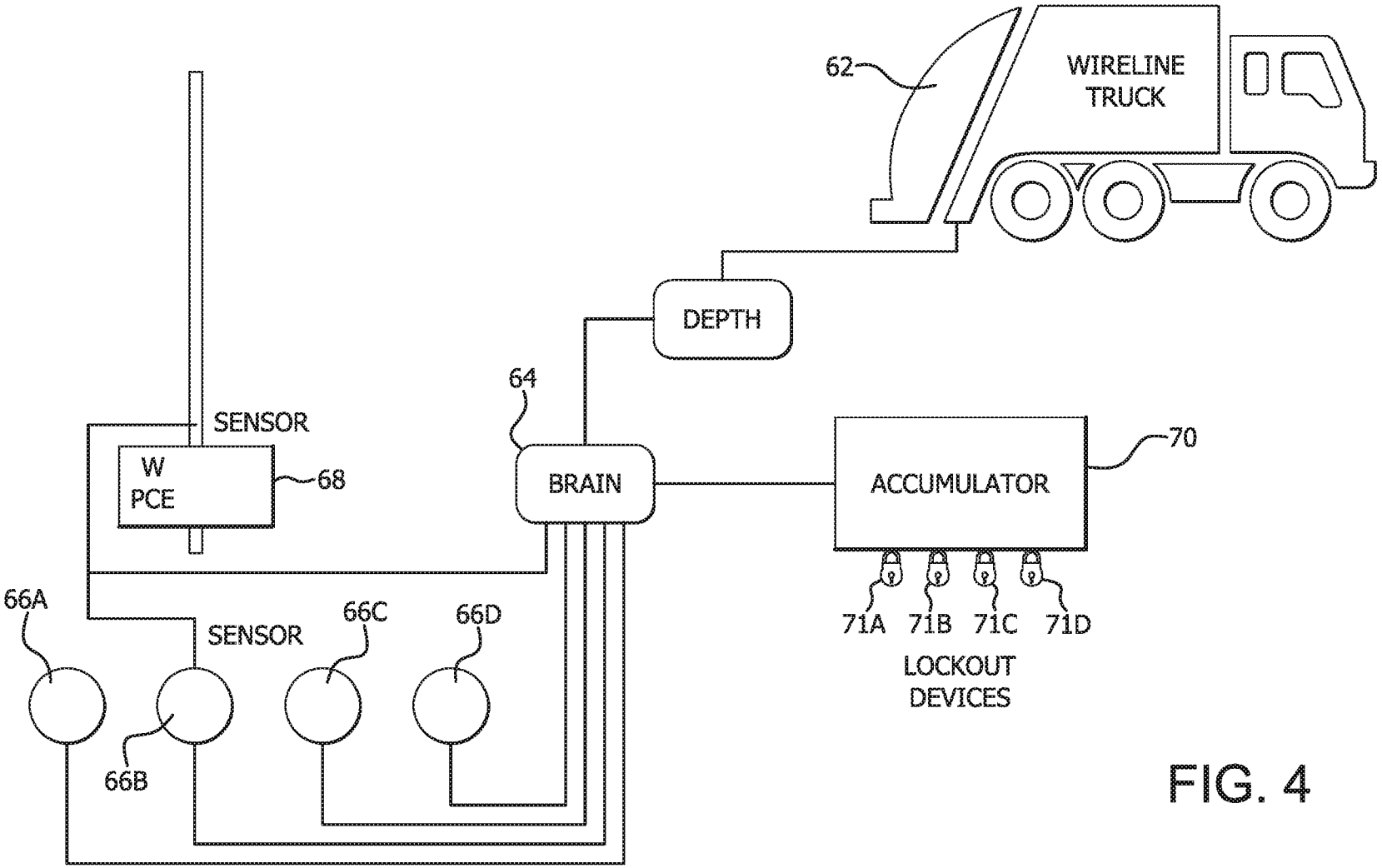
FIG. 4 is a schematic view of a depth sensor and lockout system for use with wirelines for wells.

FIG. 4 illustrates one example of a system for monitoring the presence of a wireline within a valve, and for locking out the valve when the wireline is present. The system includes a conventional wireline 58, for which the reel is disposed on a conventional wireline truck 62. Presently available wireline trucks include systems for tracking the amount of wireline that is wound on or off the reel, thus providing one indication of the depth at which the tool 56 is located. This wireline length data is fed into the microcontroller 64 for the system. The microcontroller 64 can be a general-purpose programmable microcontroller, a programmable logic device such as field programmable gate array, an application specific integrated circuit, or a custom integrated circuit. For the remainder of this description, the controller 64 will be described as a programmable logic controller or PLC. Data may be transmitted from the truck 62 (or other device containing the reel 60) to the PLC 64 using a wire connection, or any presently available wireless transmission method.

Some examples of the PLC 64 will be user-programmable so that the specific number, type, and/or depth of the valves to be locked out can be entered, so that the same PLC 64 may be used with a wide variety of combinations of wellheads/frac stacks 14 and wireline lubricators 34. Some examples of the PLC 64 will include a display for showing the battery life remaining in each of the wellhead sensors 66 and wireline lubrication sensors 68 (described below), as well as remaining battery life for the lockout mechanisms for the valves within the wellhead/frac stack 14 and wireline lubricator 34 being used. The display of some examples will also indicate the specific valves that are locked out, showing not only that the correct wellhead/frac stack 14 is locked out when appropriate, but also showing that the valves that are locked out are valves that should be locked out based on the depth of the wireline 58 and wireline tool 56. Power for some examples of the PLC can be supplied by a generator, by a battery, by a generator with a battery backup, or by solar power.

Wellhead sensors 66 will be placed on each active wellhead. As used herein, 66 will refer in general to any sensor 66, while 66A, 66B, 66C, and 66D will refer to specific sensors 66. The number of sensors 66 can be as few as one, or as many as necessary to place one on each wellhead. Each of the sensors 66 is intended to interact with the wireline lubricator sensor 68 described below, to indicate the specific wellhead/frac stack 14 for which valves should be locked out. The illustrated example of the sensors 66 can be attached to the wellhead/frac stack 14 magnetically, facilitating installation and removal of each sensor 66. The illustrated example of the sensor 66 is battery powered, and may include any presently available wireless communication means for communicating with the PLC 64 and with the wireline lubricator sensor 68 described in greater detail below. The range of wireless communication of some examples of the sensor 66 is shorter than the distance between wellheads/frac stacks 14 in order to ensure that the sensor 68 and PLC 64 are in communication with only the sensor 66 with which the wireline lubricator 34 is presently being used. The sensor 66 will include intrinsically safe components in order to avoid introducing any dangers into the well 10. Other examples may be programmed to select and communicate with the sensor 66 having the strongest signal, indicating the closest distance to the sensor 66.

The wireline lubricator sensor 68 is similar to the sensor 66, but is installed on the wireline lubricator 34. The illustrated example of the sensor 68 can be attached to the wireline lubricator 34 magnetically, facilitating installation and removal of the sensor 68. The illustrated example of the sensor 68 is battery powered, and may include any presently available wireless communication means for communicating with the PLC 64 and with the sensor 66 for the wellhead 12 to which the wireline lubricator 34 is attached. Examples of the sensors 66, 68 would use the interaction of the sensors 66, 68 to determine which wellhead/frac stack 14 will be involved in a lockout operation, communicating this information to the PLC 64.

As a wireline operation is conducted, the PLC 64 will receive information from the sensors 66, 68 about which well is involved in a wireline operation. Using the depth information from the truck as well as the information from the sensors 66, 68, the PLC 64 will include executable instructions to lock out any of the valves at or above the level of the tool 56, permitting closure of any valve below the level of the tool 56. Appropriate control signals will be sent to the accumulator 70, which controls the lockout function of the various valves using the lockout devices 71A, 71B, 71C, and 71D (reference character 71 refers in general to the lockout devices, while 71A, 71B, 71C, and 71D refer to individual lockout devices). Lockout will be accomplished by a hydraulic ram which will resist closure of the valve when hydraulic pressure is present within the ram. Some examples will include an emergency override so that the lockout can be bypassed in the event of an emergency. Some examples of this emergency override can be a button, a pull pin, or other control on the valve itself, so that pressing the button, pulling the pull pin, or otherwise activating the control releases hydraulic pressure on the ram, permitting closure of the valve. Some examples may also include a battery backup, so that if power is lost, the emergency override can still be activated.

In use, the wireline lubricator 34 will be mounted on the appropriate wellhead 12, and the wireline tool 56 and wireline 58 will be connected and lowered through the wireline lubricator 34 in the conventional manner. The PLC 64 will receive a signal from the sensors 66, 68 as well as the depth data from the truck. Since the sensor 68 is in communication with the sensor 66 for the wellhead/frac stack 14, the PLC 64 will know which wellhead/frac stack 14 will be involved in lockouts as soon as data is received from the wireline lubricator sensor 68. The PLC 64 will then use the depth data from the truck 62, as well as information about the location of the valves, to determine which valves must be locked out as the tool 56 and wireline 58 are lowered towards and into the wellbore/frac stack 14. Inadvertent closure of these valves will thus be resisted while the wireline 58 is within these valves, but emergency closure of these valves will still be permitted. As the tool 56 is raised back up through the wellhead/frac stack 14 and wireline lubricator 34, valves will be unlocked as the tool 56 rises above each of these valves.

Figure 5:
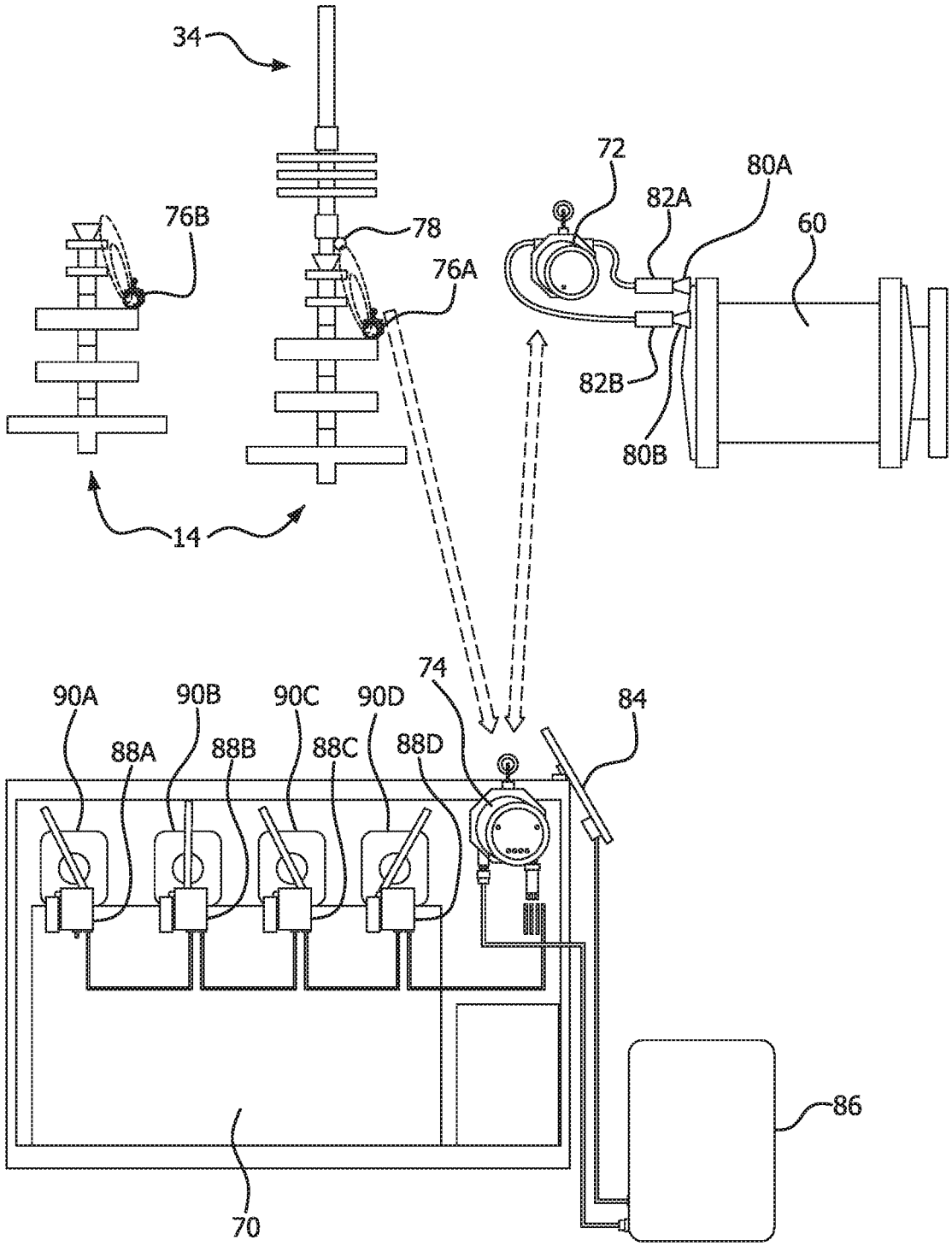
FIG. 5 is another schematic view of a depth sensor and lockout system for use with wirelines for wells.

Another example of the monitoring system is illustrated in FIG. 5. The example of FIG. 5 utilizes at least three monitoring units: a wireline unit 72, an accumulator unit 74, and at least one wellhead unit 76, with wellhead units 76A, 76B being shown in the illustrated example. Reference character 76 is used herein to refer to any of the wellhead units in general, while 76A, 76B, 76C, etc. are used to refer to individual wellhead units. Each of the three monitoring units 72, 74, 76 have similar components, with each of the components being populated slightly differently to account for the different functions of these devices.

Referring to FIG. 5, each wellhead unit 76 is attached to a wellhead/frac stack 14. The wellhead unit 76 includes a sensor to detect the presence of a lubricator 34 placed on top of the wellhead/frac stack 14. In the illustrated example, BLUETOOTH beacon 78 is secured to the lubricator 34. BLUETOOTH is a registered trademark which is well-known and used to identify a short wave radio frequency wireless communication system. When lubricator 34 is placed on top of the wellhead 14, the BLUETOOTH receiving unit (described in greater detail below) of the wellhead unit 76 detects the presence of the BLUETOOTH beacon 78. Other sensors could also be used, for example, RFID, magnetic proximity sensors, or the like. Once the wellhead unit 76 detects the presence of the lubricator 34, this information is communicated to the accumulator unit 74.

Figure 6:
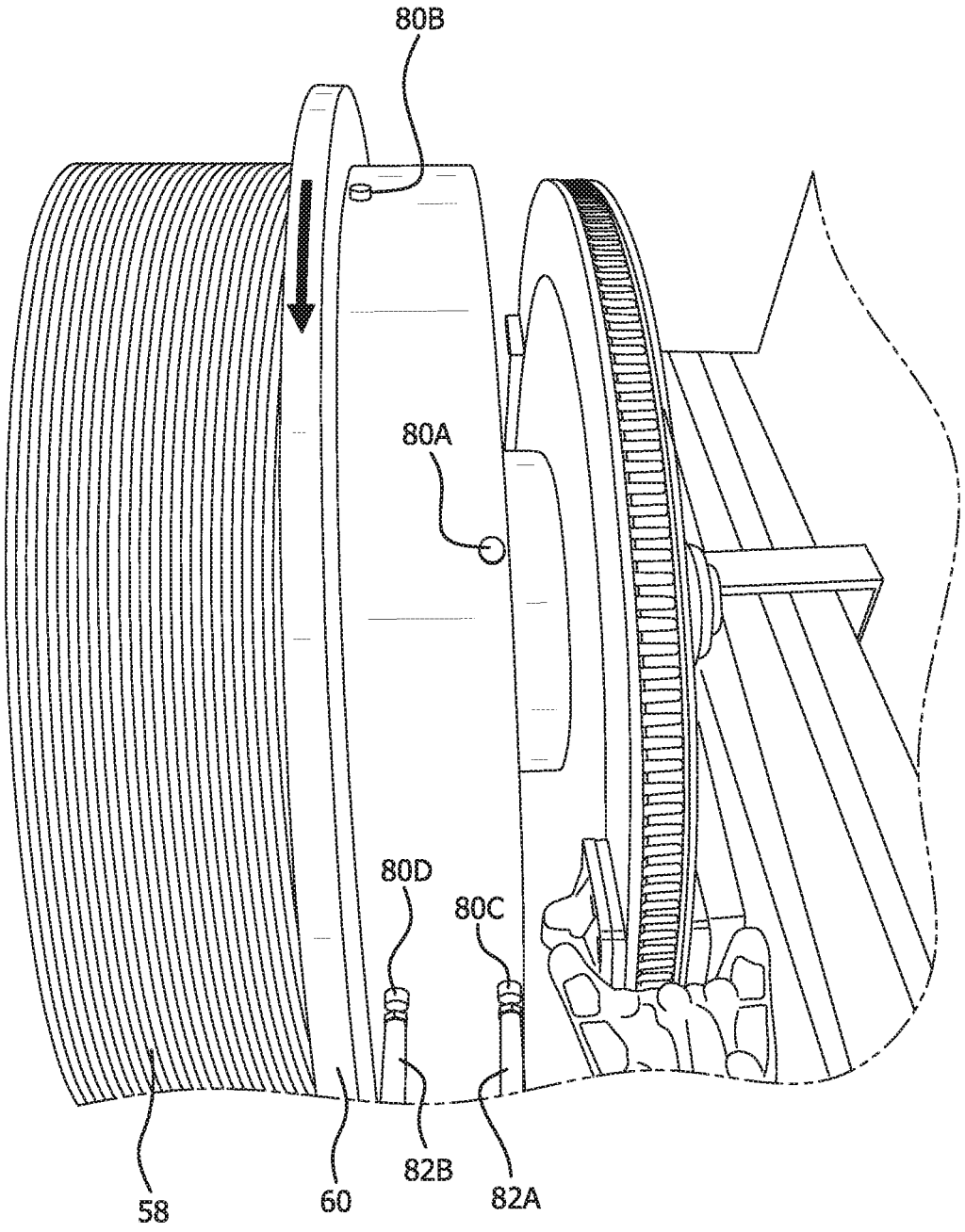
FIG. 6 is a front elevational view of a wireline drum, showing sensors for use with the depth sensor and lockout system of FIGS. 4-5.
Figure 7:
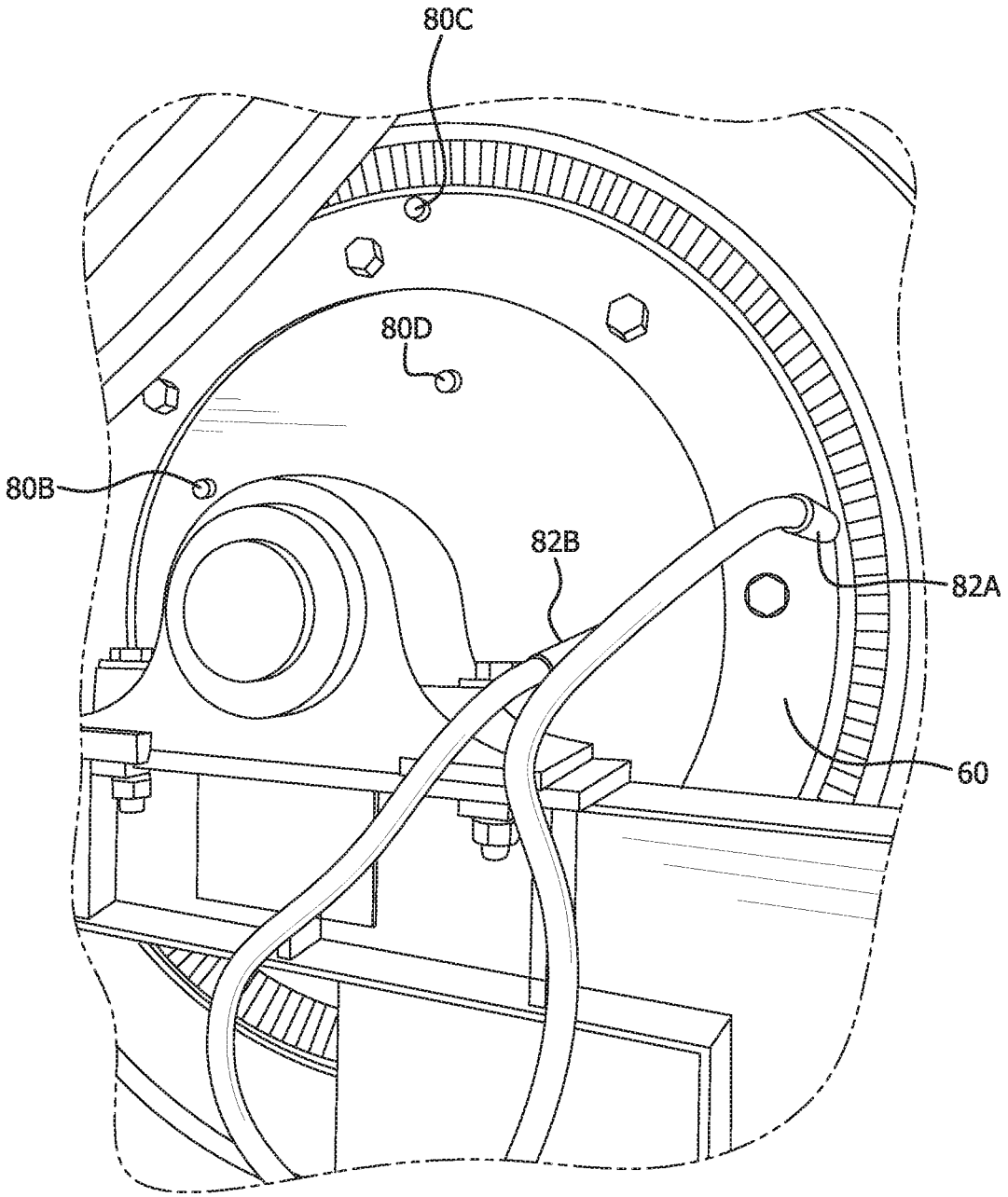
FIG. 7 is a side elevational view of a wireline drum, showing alternative sensors for use with the depth sensor and lockout system of FIGS. 4-5.

As shown in FIGS. 5-7, the wireline unit 72 is structured to detect rotation of the drum 60 upon which the wireline 58 is wound. In some examples, the wireline unit 72 includes at least one sensor, with the sensor being configured to detect the passage of a plurality of detectable elements attached to one side of the drum 60. In the illustrated example, a plurality of magnets 80, which in the illustrated example are magnets 80A, 80B, 80C, 80D attached to the wireline drum 60. Other examples of detectable elements could be RFID tags. The wireline unit 72 is operatively connected to a first proximity sensor 82A and a second proximity sensor 82B. The proximity indicators 80A,80B are positioned on the wireline reel so that they are detected as they pass the proximity sensors. A first magnet 80A is positioned on the drum 60 so that as it passes the sensors 82A, 82B, it will be detected by the first proximity sensor 82A, but not the second proximity sensor 82B. A second magnet 82B is positioned the drum 60 so that as it passes the wireline unit 72, it will be detected by the second proximity sensor 82B, but not the first proximity sensor 82A. Index location magnets 80C, 80D are positioned so that they will be detected at the same time, with 80C being detected by sensor 82A while magnet 80D is simultaneously detected by sensor 82B. In the illustrated example, the magnets 82A, 82B and the index location of 80C, 80D are positioned sufficiently far apart from each other so that the timing between detection of magnet 82A, 82B, and the index location can be used to determine the direction of rotation. As an example, a separation of 15 inches is adequate for a drum speed of 1,000 feet per minute. Thus, the timing and order in which the proximity sensors 82A, 82B detect the presence of the magnets 80A, 80B, and the index location can be used to determine the direction of rotation of the drum 60. In other examples, other means of detecting rotation, for example, an encoder or a camera can be utilized as the rotation sensor. The number of rotations of the drum 60, as well as the diameter of the wireline 58 wound around the drum 60, can be used to determine the amount of wireline 58 that has been wound or unwound. This information can then be provided to the accumulator unit 74. When the accumulator unit 74 determines that the amount of wireline 58 which has been unwound exceeds a predetermined threshold, then the accumulator unit 74 will lockout the valves associated with the wellhead upon which the wellhead unit 76 has detected the lubricator, in a manner that is described in greater detail below.

The system includes a controller, which can be a separate device, or which can form part of the accumulator unit 74, one of the wellhead units 76, or the wireline unit 72. In the illustrated example, the controller is incorporated into the accumulator unit 74. Any use of the term "controller" separately from the accumulator is not to be interpreted as requiring the controller to be a separate device, and includes the possibility of a separate device as well as a controller that is part of the accumulator unit 74, wellhead unit 76, or wireline unit 72. The accumulator unit 74 receives the signals from the wellhead unit 76 and wireline unit 72, enabling the accumulator unit 74 to decide which wellhead(s) to lockout. The accumulator unit 74 serves as the overall controller of the monitoring and lockout system, receiving information from the wireline unit(s) 72 and wellhead unit(s) 76, in the illustrated example by wireless communication such as BLUETOOTH or other radio frequency communication.

Figure 8:
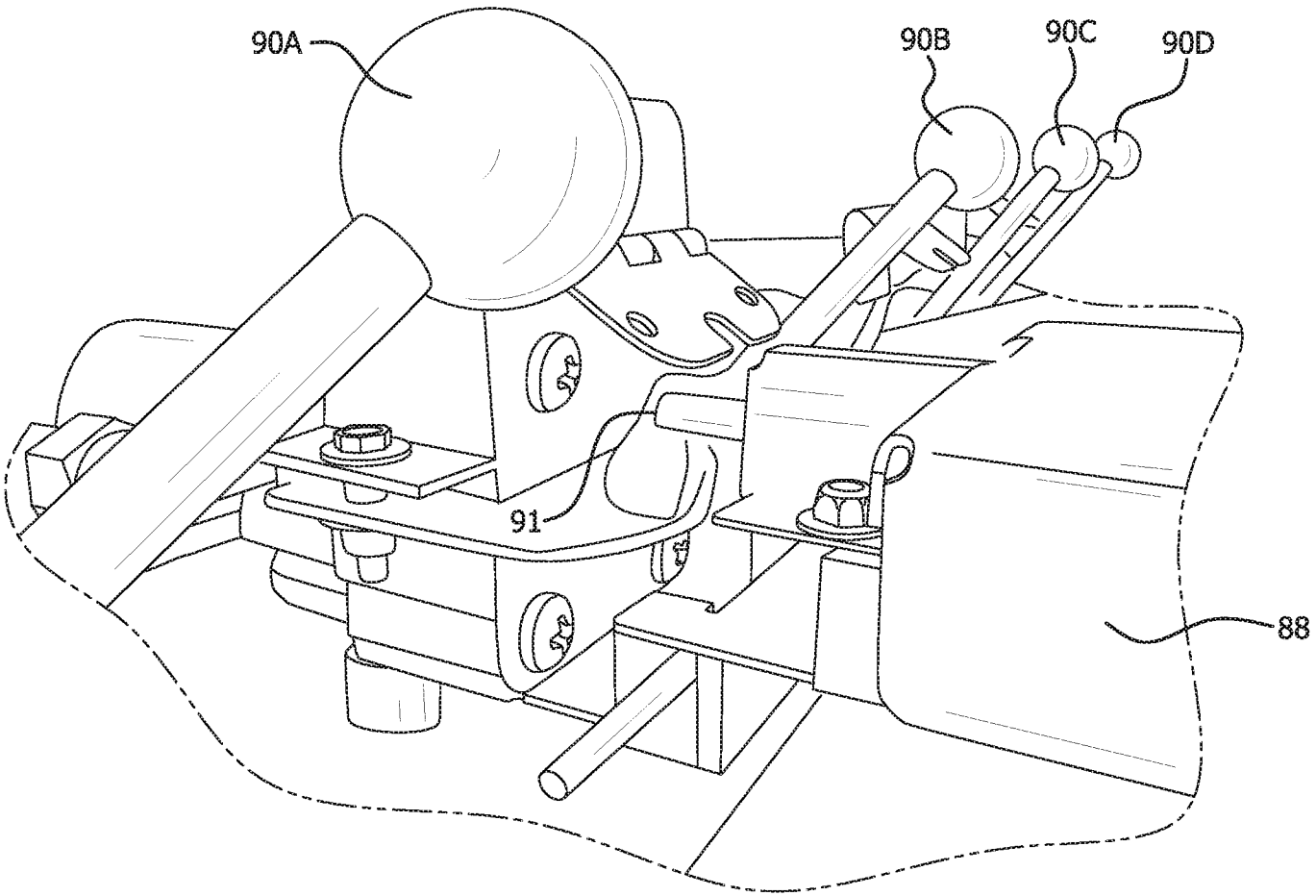
FIG. 8 is an environmental, perspective view of a lockout mechanism for use with the depth sensor and lockout system of FIGS. 4-5, showing the lockout mechanism in place for use in connection with a valve lever.

As shown in FIGS. 5 and 8, the illustrated example of the accumulator unit 74 includes a solar panel 84 and a rechargeable battery pack 86. In the illustrated example, the rechargeable battery pack 86 utilizes lead acid cells which are connected to a standard charging circuit in a manner well known to those skilled in the art. The battery pack 86 is electrically connected to the accumulator unit 74 to provide power to the accumulator unit 74, and the solar panel 84 is electrically connected to the battery pack 86 to provide a means for ensuring that the battery pack 86 remains sufficiently charged. The accumulator unit 74 is also electrically connected to a lockout unit 88 corresponding to each of the valve controls 90 on the accumulator 70. As used herein, 88 refers in general to the lockout units, and 88A, 88B, 88C, and 88D refer to specific lockout units, which in the illustrated example are linear actuators. Similarly, 90 refers in general to the valve controls, while 90A, 90B, 90C, and 90D refer to specific valve controls. Each lockout unit 88A, 88B, 88C, 88D is secured to the accumulator 70 in proximity to the corresponding valve control 90A, 90B, 90C, 90D so that each linear actuator 88A, 88B, 88C, 88D may be used to prevent movement of each valve 90A, 90B, 90C, 90D as needed. When the lubricator is detected by the wellhead unit 76 and the presence of wireline 58 within the wellhead 14 is indicated by the wireline unit 72, then the appropriate lockout unit is activated to prevent movement of the valve control 90 on the accumulator 70 for that wellhead 14. In the illustrated example, a bar 91 (FIG. 8) is moved by the lockout unit 88 into the path of the valve control 90, resisting movement of the valve control 90. Once the wireline unit 72 signals that the wireline 58 has been removed from the wellhead 14, the accumulator unit 74 deactivates the appropriate lockout unit 88 to permit movement of the valve control 90. Some examples also include an emergency control for quickly deactivating the lockout unit 88 in the event that closing a valve becomes necessary despite wireline within the wellhead.

Figure 9:
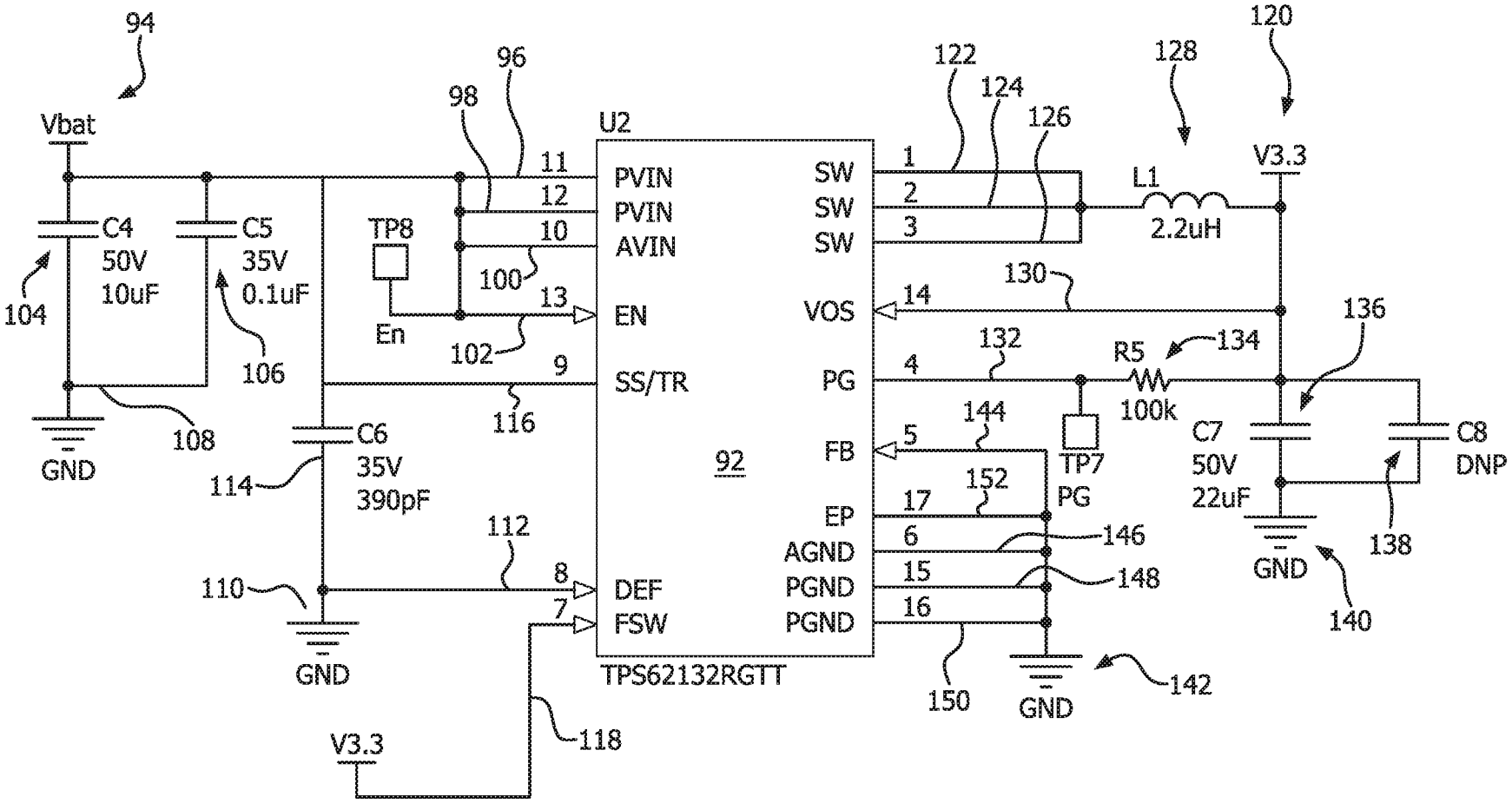
FIG. 9 is a schematic diagram of a portion of a power supply circuit for the depth sensor and lockout system of FIGS. 4-5.

FIG. 9 illustrates the power regulation circuit for each of the monitoring units 72, 74, 76. The power source for the accumulator unit 74 was discussed above. Power is supplied to each of the wireline units 72 and wellhead units 76 by a battery. In the illustrated example, the battery is formed from a pair of Lithium Thionyl Chloride cells connected in series. Power from the battery is supplied to a power supply chip 92 in order to provide the correct voltage and current to the remaining electronics. In the illustrated example, the power supply chip 92 is a step-down converter chip TPS62132RGTT made by Texas Instruments. The voltage from the battery 94 is connected to both of the supply voltage pins 96, 98 for the power circuitry, as well as the supply voltage pin 100 for the control circuitry and the chip enable 102. In the illustrated example, a pair of capacitors 104, 106 are provided between the battery voltage 94 and a ground 108 to ensure consistent voltage supply. The ground 110 is connected to the output voltage scaling pin 112, setting the output voltage to normal. The same ground 110 is connected through a capacitor 114 to the soft start tracking pin 116, setting the internal voltage reference. In the illustrated example, the switching frequency is set so low by connecting a voltage source to switching frequency pin 118. The output of the power supply is shown at 120, connected to the switch node pins 122, 124, 126 through the inductor 128, as well as to the output voltage sense pin 130 and output power pin 132 through the resistor 134. In the illustrated example, a pair of capacitors 136, 138 are provided between the output voltage 120 and a ground 142 provide a smoother output voltage. The ground 142 is connected to the voltage feedback 144, analog ground 146, power ground 148, 150, and the exposed thermal pad 152. Expressed more simply, the input power from the battery from 94, 110 provided through the chip 92 produces an output power between 120 and 142, which can then be supplied to the remainder of the components of the units 72,74,76.

Figure 10:
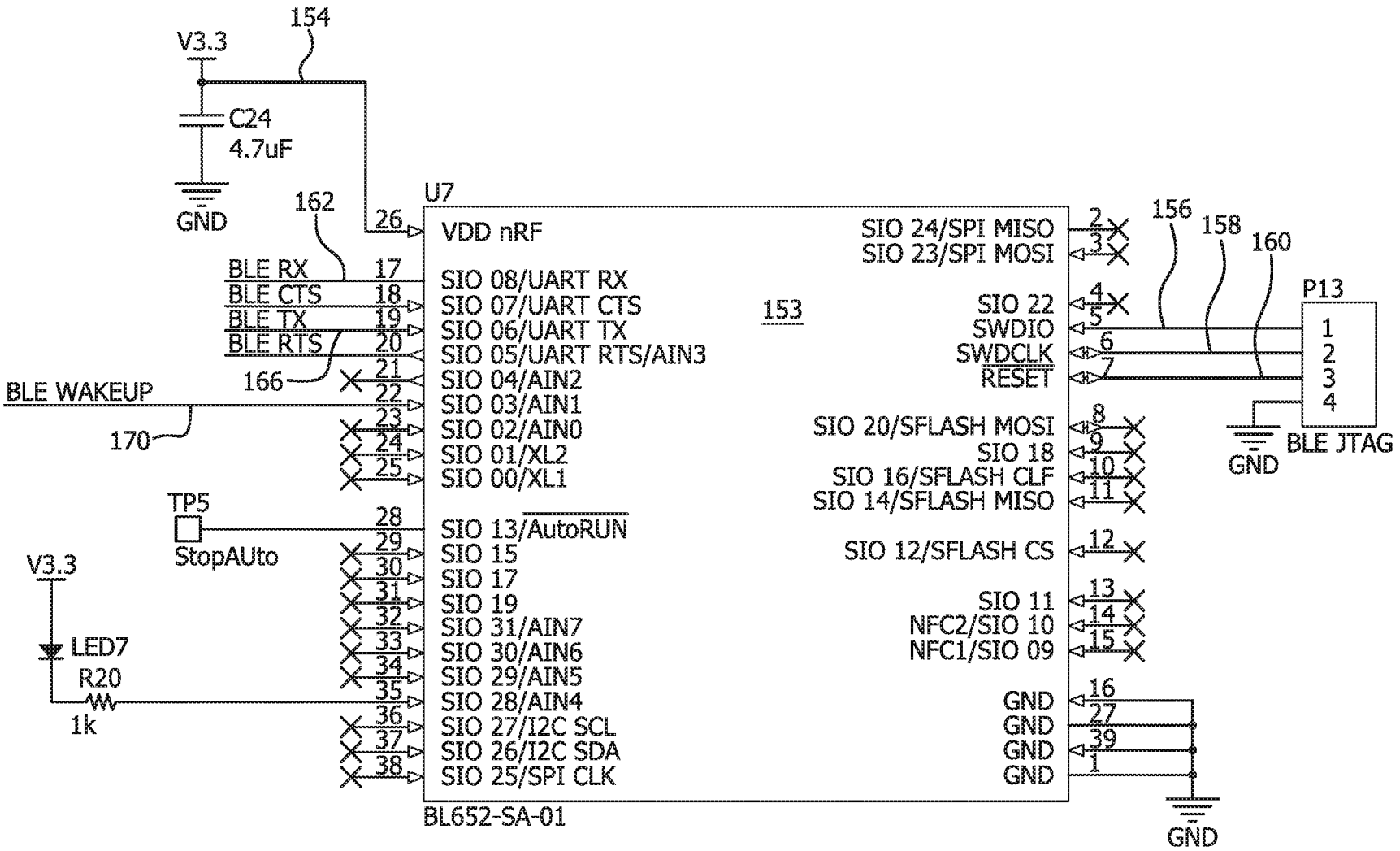
FIG. 10 is a schematic diagram of a BLUETOOTH circuit of the depth sensor and lockout system of FIGS. 4-5.

The illustrated example of the wellhead unit 76 uses BLUETOOTH to detect the presence of the BLUETOOTH beacon 78 attached to a wireline lubricator 34, as well as to permit programming of any of the units 72,74,76 through a BLUETOOTH connection to a smart phone, tablet computer, or the like. FIG. 10 illustrates an example of a BLUETOOTH communication chip 153, which in the illustrated example is a BLUETOOTH chip no. BL652-SA-01 which is available from Laird. Power is supplied to the chip through pin 154, with the correct voltage being provided from the above-described the power supply chip 92. Pins 156, 158, 160 are used as one means of providing programming input to the chip. Pins 162 and 166 are connected to the microcontroller as discussed in greater detail below. Similarly, pin 170 is also connected to the microcontroller, and is used to wake up the microcontroller when a BLUETOOTH signal is detected.

Figure 11:
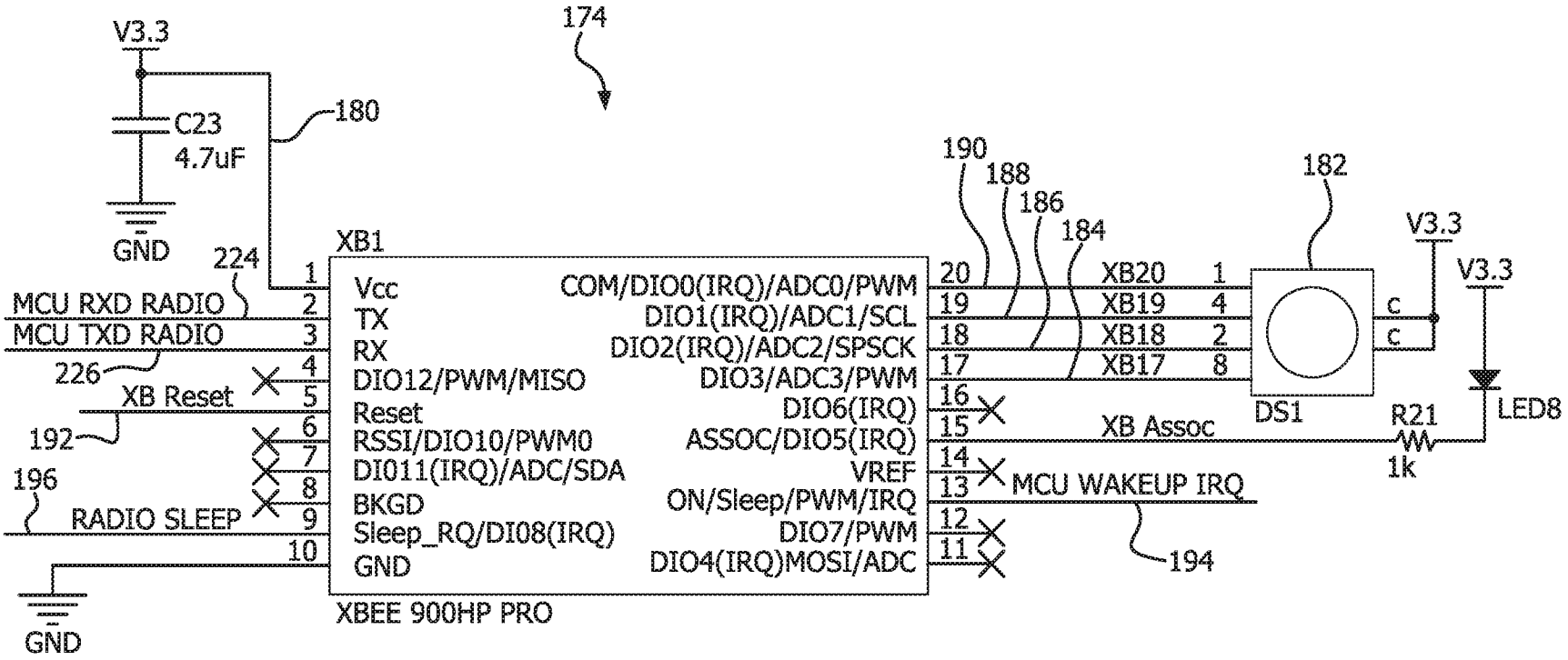
FIG. 11 is a schematic diagram of a radio frequency communication circuit of the depth sensor and lockout system of FIGS. 4-5.
Figure 12:
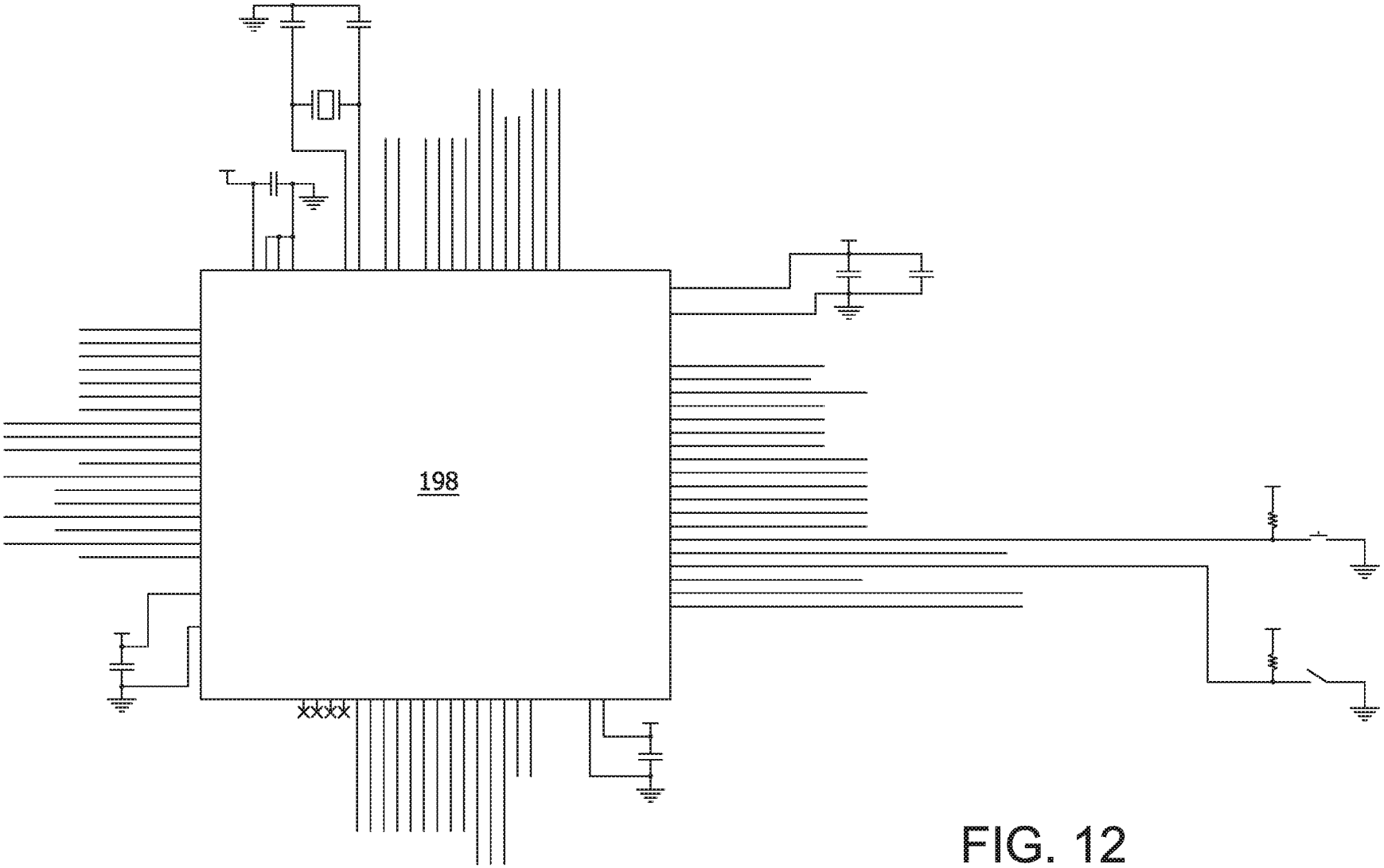
FIG. 12 is a schematic diagram for a microcontroller for the depth sensor and lockout system of FIGS. 4-5.
Figure 13:
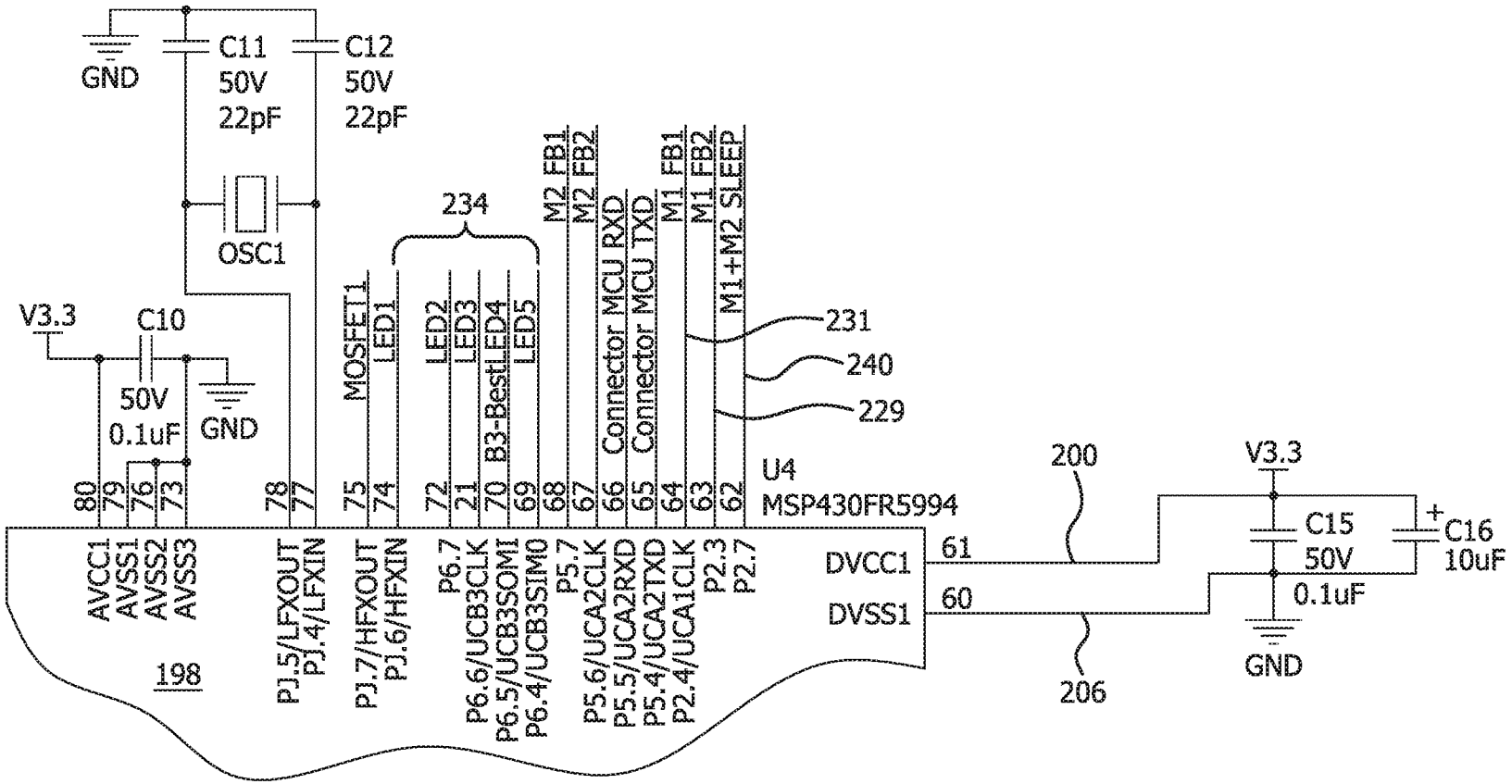
FIG. 13 is a schematic diagram for a first portion of a microcontroller for the depth sensor and lockout system of FIGS. 4-5.
Figure 14:
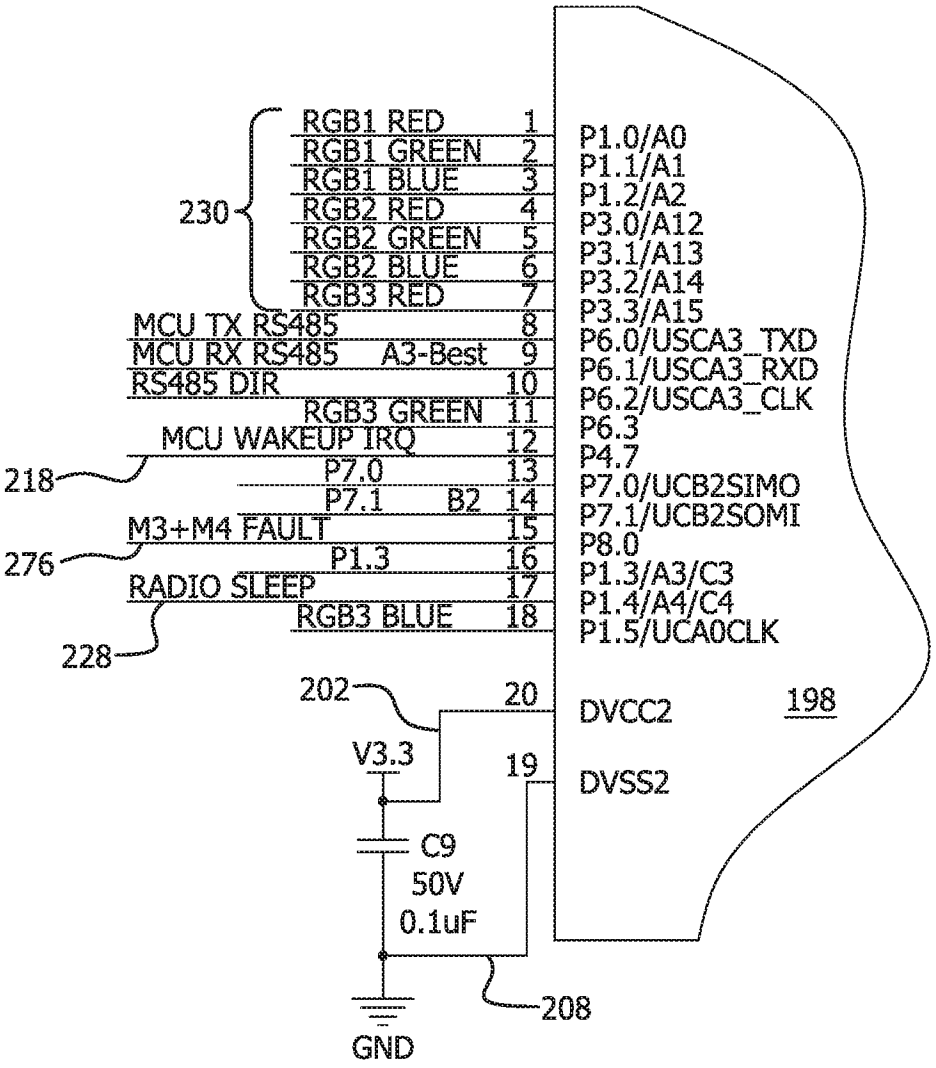
FIG. 14 is a schematic diagram for a second portion of a microcontroller for the depth sensor and lockout system of FIGS. 4-5.
Figure 15:
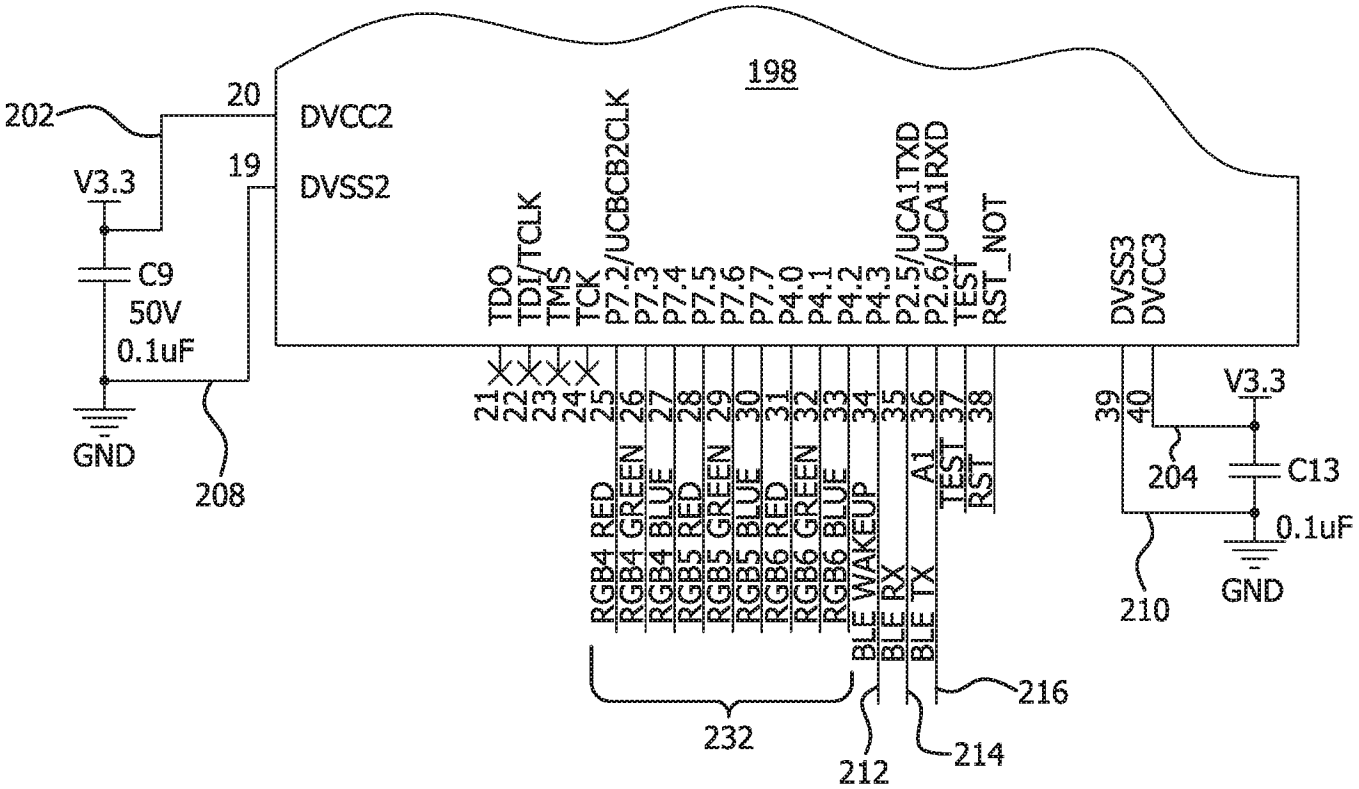
FIG. 15 is a schematic diagram for a third portion of a microcontroller for the depth sensor and lockout system of FIGS. 4-5.
Figure 16:
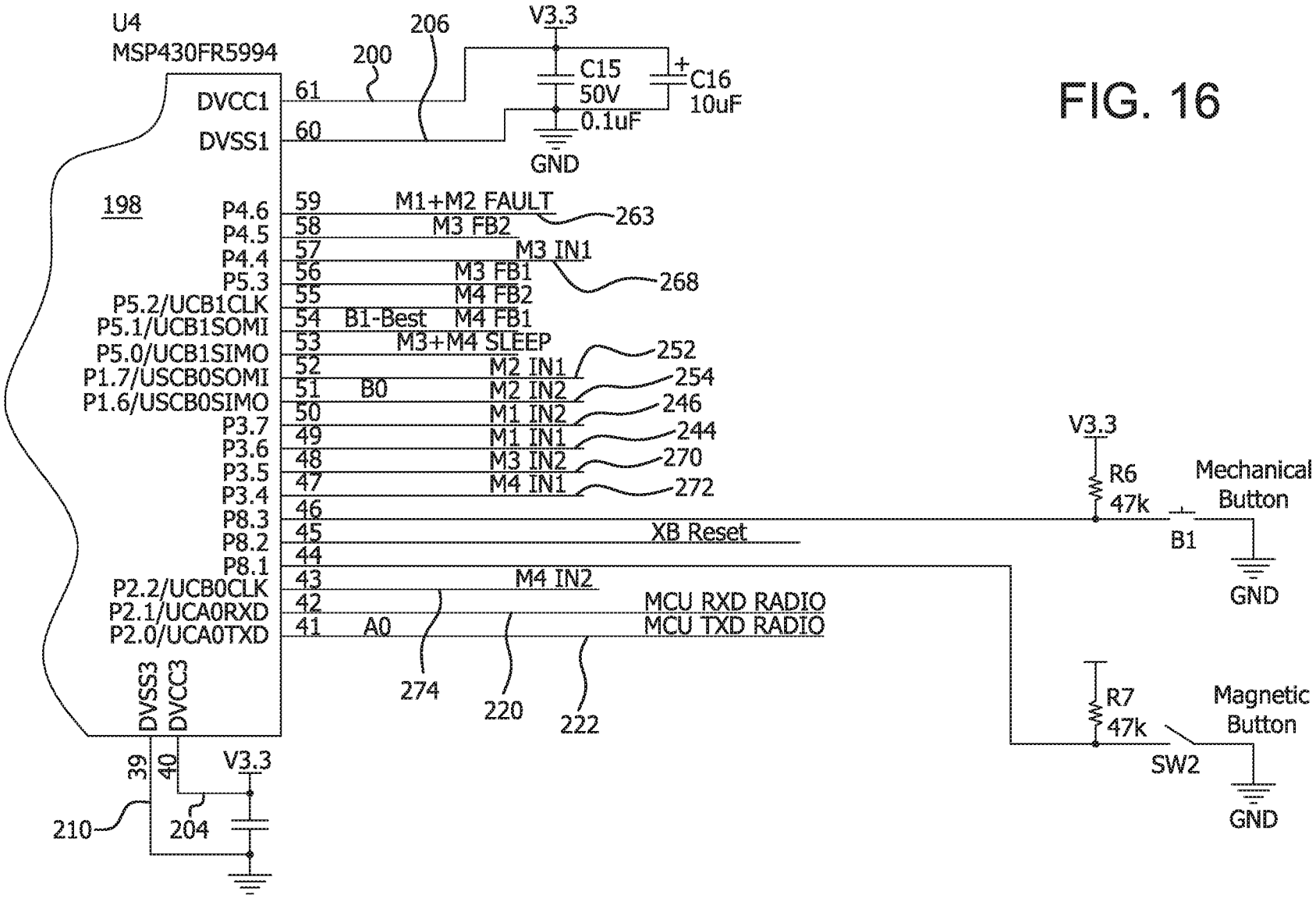
FIG. 16 is a schematic diagram for a fourth portion of a microcontroller for the depth sensor and lockout system of FIGS. 4-5.

Referring to FIG. 11, a radiofrequency chip 174 that is present in each of the units 72, 74, 76 and which is used for communication between the units 72, 74, 76 is illustrated. In the illustrated example, the chip 174 is a Digi XBEE 900 HP PRO chip. Power is supplied to the radiofrequency chip 174 from the power supply chip 92. The chip 174 is connected to a DIP switch 182 by pins 17 (184), 18 (186), 19 (190), 20 (190). The remaining connections from the radiofrequency chip 174 or with the microcontroller, as explained in greater detail below. Specifically, pin five (192) is connected to pin 45 of the microcontroller, providing a reset function for the radiofrequency chip. The radiofrequency chip 174 can be woken up by the microcontroller through the connection between 1045 of the microcontroller and pin 9 (196) of chip 174. The radiofrequency chip 174 can likewise wake up the microcontroller through the connection between pins 45 of the microcontroller and pin 9 (196) of the radiofrequency chip 174. Unlike the BLUETOOTH chip 92, the radiofrequency chip 174 is kept in a sleep state until needed, at which point it is woken up by the microcontroller as explained in greater detail below.

Referring to FIGS. 12-16, the microcontroller chip for each of the units 72, 74, 76 is illustrated. The same microcontroller chip 198 is utilized for each of the units 72, 74, 76, but not all connections are necessary for all of the units 72, 74, 76. For example, only the accumulator unit 74 needs output connections for the motor controls for the actuators as described below. As another example, the wellhead units 76 can be woken up by detection of the BLUETOOTH beacon for the wireline lubricator, but this is inapplicable to the wireline unit 72 or accumulator unit 74 (although BLUETOOTH programming of the other units would still potentially be applicable). Similarly, the wireline unit 72 needs to receive the inputs from the proximity sensors, but not the wellhead unit 76 or accumulator unit 74.

The microcontroller chip 198 can be a general-purpose programmable microcontroller, a programmable logic device such as field programmable gate array, an application specific integrated circuit, or a custom integrated circuit. In the illustrated example, the microcontroller chip 198 is a MSP430FR5994 embedded microcontroller chip available from Texas Instruments. Power is applied to the chip 198 through three different sets of pins, with the appropriate voltage being supplied to pins 200, 202, 204, and with pins 206, 208, 210 being connected to ground. Pin 34 (212) is used to receive the wake-up signal from the BLUETOOTH chip 153 (particularly in the case of the wellhead units 76), and pins 35 (214) and 36 (216) are used to communicate with pins 17 (162) and 19 (166) of the BLUETOOTH chip 153. Similarly, when the microcontroller chip 198 needs to communicate with the radiofrequency chip 174, 1012 (218) can provide a wake-up signal to pin 9 (196) of the radiofrequency chip 174. Pins 42 (220) and 41 (222) can then be used to communicate with the radiofrequency chip 174 through pins 2 (224) and 3 (226), respectively. Once radio communication is complete, the microcontroller chip can put the radiofrequency chip 174 back to sleep using a signal from pin 17 (228) to pin 9 (196) of the radiofrequency chip 174. The microcontroller chip 198 for the wireline unit 72 can receive signals from the proximity sensors 82A,82B at pins 63 (229) and 64 (231). The microcontroller chip 198 for the accumulator unit 74 can also communicate with motor controller chips for controlling the linear actuators used to activate and deactivate the lockouts on the accumulator, as explained in greater detail below. The microcontroller chip also controls a plurality of status indicators, which in the illustrated example are light sources in the form of LED's, through pins 1-7 (230), 25-33 (232), and 69-75 (234).

Figure 17:
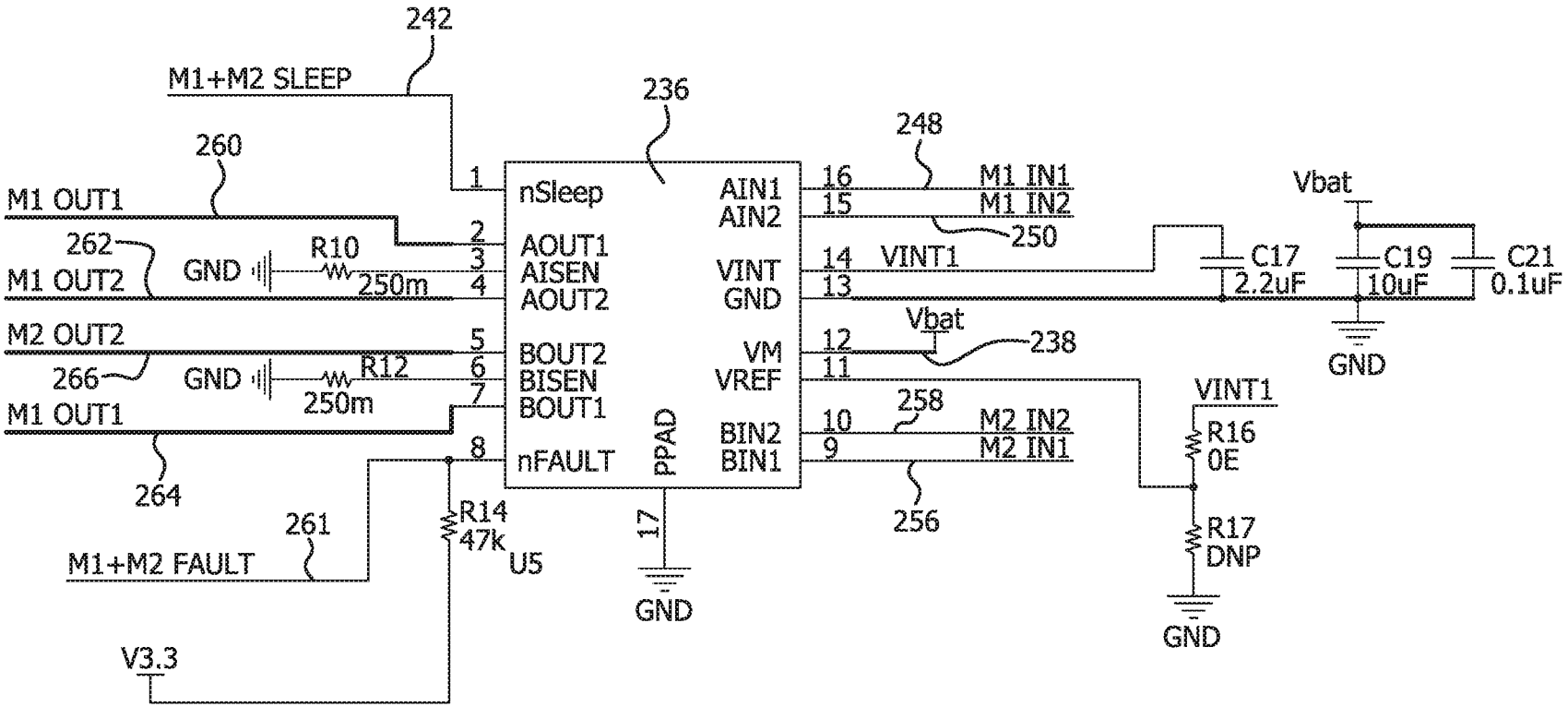
FIG. 17 is a schematic diagram for a motor driver chip for the depth sensor and lockout system of FIGS. 4-5.

Referring to FIG. 17, a motor control chip 236 is illustrated. In the illustrated example, the motor control chip 236 is a DRV8848PWPR Dual H-Bridge Motor Driver available from Texas Instruments. The chip 236 can be activated or put into a sleep state through a signal from pin 62 (240) to pin 1 (242) on the motor control chip 236. The activation and direction of one motor can be controlled by signals from pins 49 (244) and 60 (246) of microcontroller chip 198 to pins 16 (248) and 15 (250), respectively, thus controlling the activation and direction of one of the linear actuators for one lock out. Similarly, the activation and direction of a second motor can be controlled by a signal from pin 52 (252) or 51 (254) of the microcontroller 198 to pins nine (256) or 10 (258) of the motor control chip 236, thus controlling the activation and direction of a second linear actuator for a second lock out. Problems with either the first or second motor can be communicated from pin 8 (261) of chip 286 to pin 59 (269) of chip 198. Appropriate signals are then sent to the first motor through pin to (260) or pin for (262) to control the first motor, or through pins seven (264) or pins five (266) to control the second motor. Thus, each chip 236 controls two motors. In a system such as the illustrated system with four lockouts, two chips 236 will be required to control for linear actuators, controlling for lockouts. The third motor, for example can be controlled by pins 57 (268) and 48 (270). The fourth motor can be controlled by pins 47 (272) and 43 (274). Any problems with the third or fourth motor are communicated through pin 15 (276).

The operation of the monitoring device is illustrated in FIGS. 17-20B. Referring to FIG. 17, the operation of the wellhead unit 76 is illustrated. Upon startup, each wellhead unit 76 begins by retrieving the wellhead number from memory at step 278. Next, an opportunity for a connection to a smart phone, tablet computer, etc. for any settings changes is provided at step 280. Once settings are finalized, the wellhead unit 76 enters a sleep mode at step 282. The wellhead unit 76 wakes up to scan for the Bluetooth beacon of the lubricator 34 at a predetermined time interval, which in the illustrated example is three times per minute, at step 284, recording the signal strength at step 286, and storing the average of three scans at step 288. The wellhead units 76 transmit the status at predetermined time intervals, which in the illustrated example is about once per minute, at step 290. The average of the last three scans is transmitted to the controller at step 292.

Figure 18:
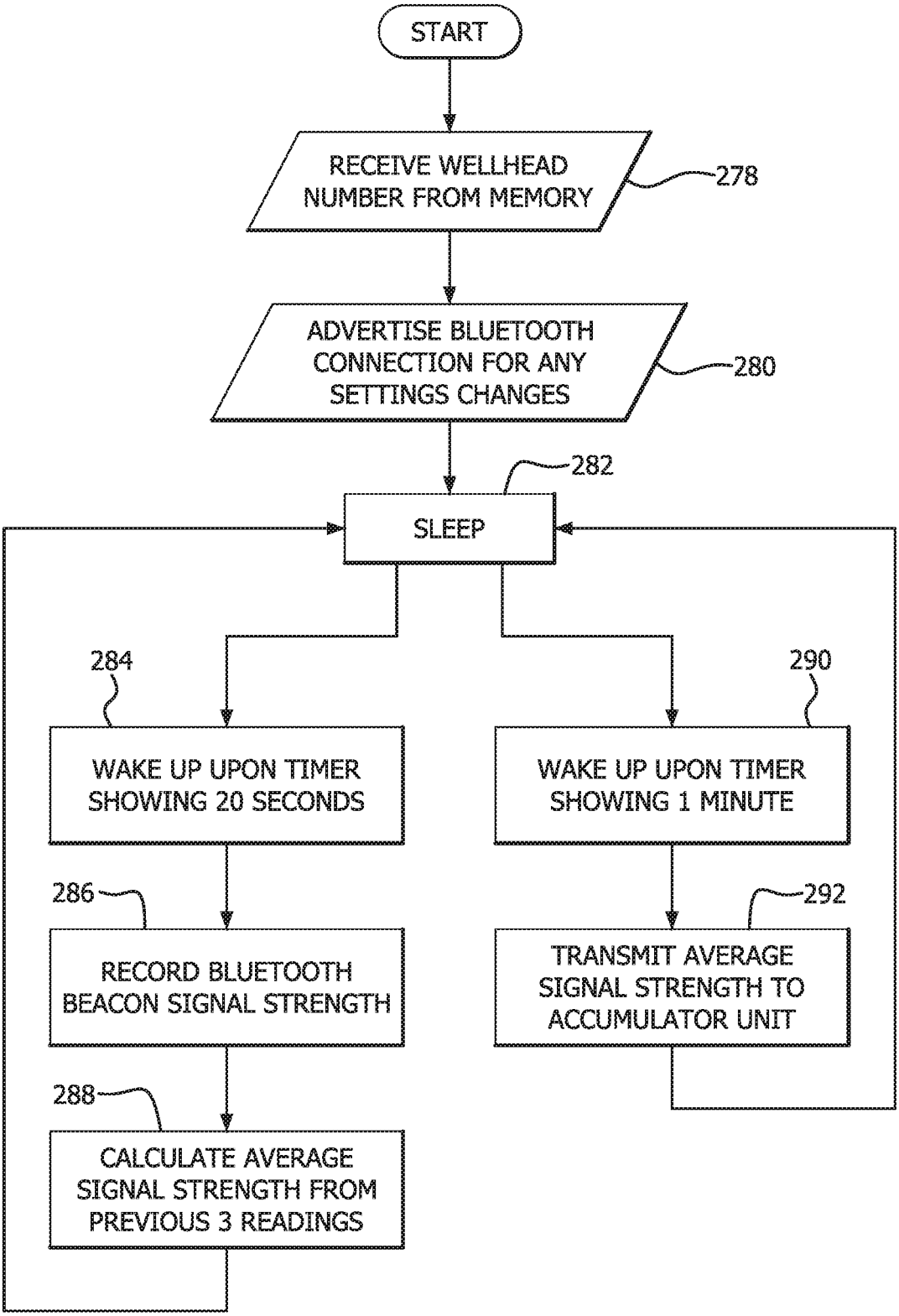
FIG. 18 is a flowchart depicting operation of a wellhead unit for the depth sensor and lockout system of FIGS. 4-5.
Figure 19:
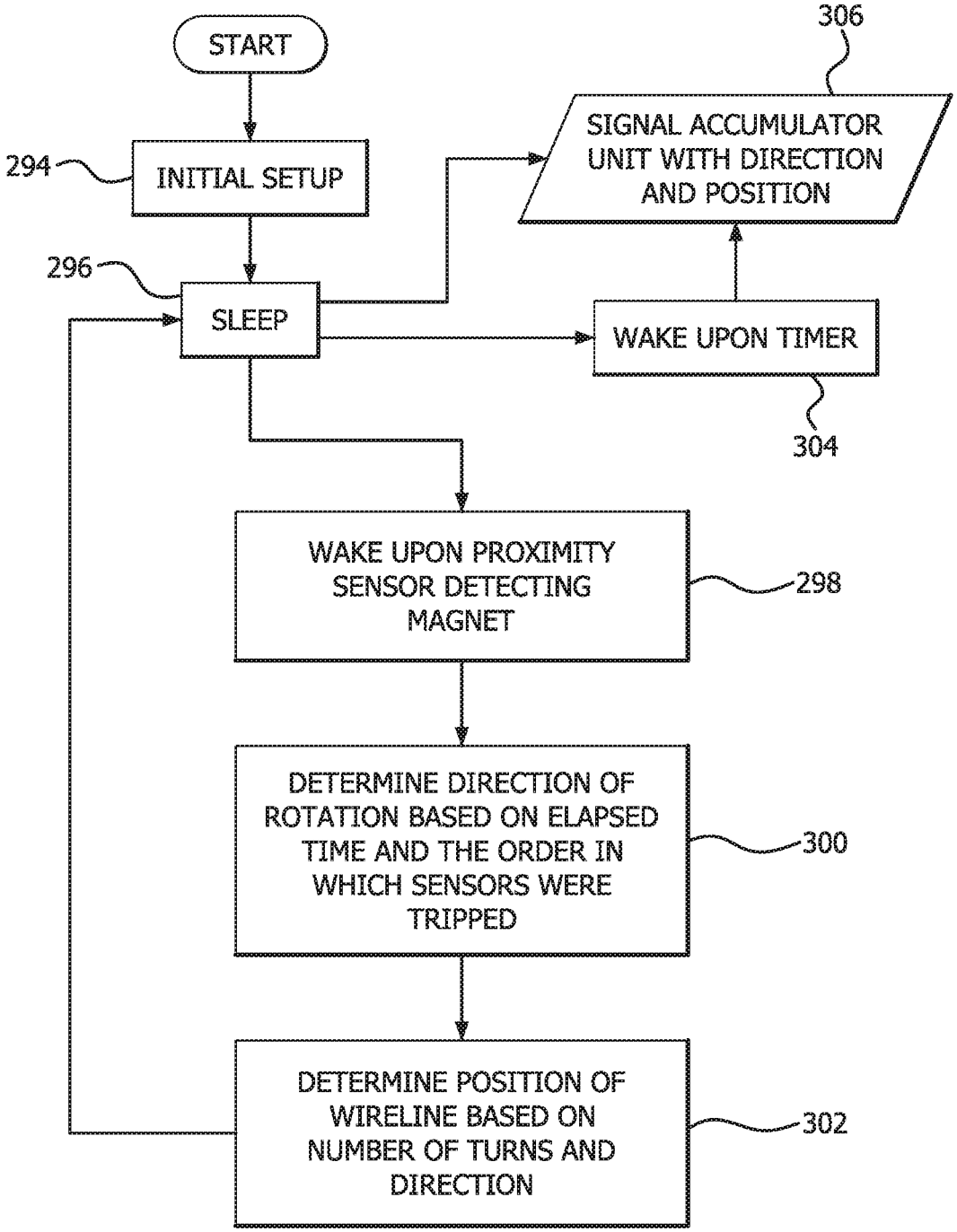
FIG. 19 is a flowchart depicting operation of a wireline unit for the depth sensor and lockout system of FIGS. 4-5.

The operation of the wireline unit 72 is illustrated in FIG. 18. The initial setup occurs at step 294, after which the wireline unit 72 sleeps at step 296. The wireline unit 72 wakes upon a proximity sensor detecting a proximity indicator (magnet in this example) at step 298. If either sensor a is tripped, then the wireline unit 72 begins tracking the time since the sensor was tripped at step 296. The direction of rotation of the reel is determined at step 300 based on the timing and sequence of the detection of proximity indicators 80A, 80B, 80C, and 80D. The position of the wireline is determined at step 302 based on the number of rotations of the reel, as well as the rotation direction. In the illustrated example, the wireline unit wakes in response to the timer at step 304, and information is sent to the accumulator unit 74 at a predetermined time interval, which in the illustrated example is once per minute at step 306.

Figure 20:
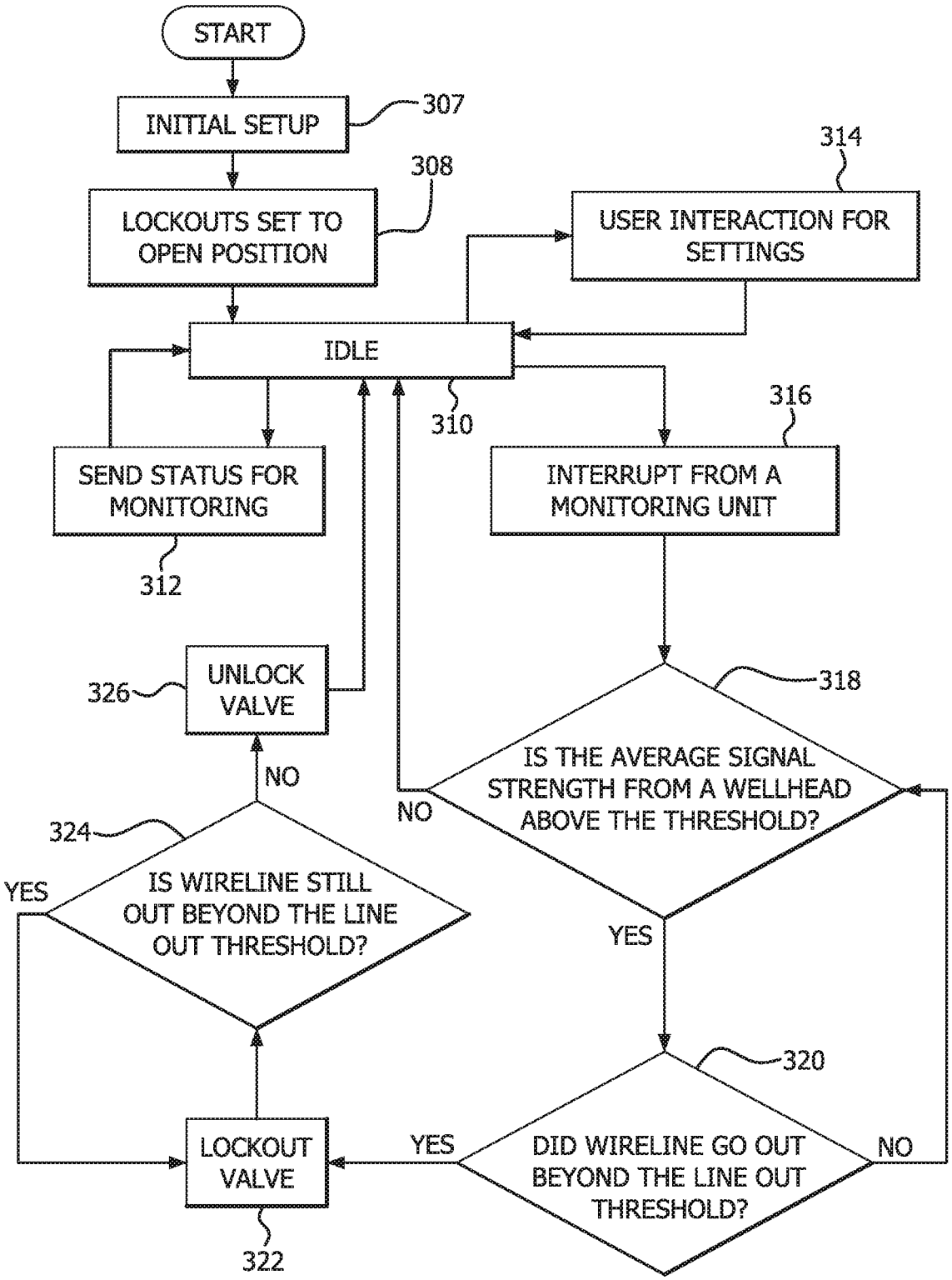
FIG. 20 a flowchart depicting operation of an accumulator unit for the depth sensor and lockout system of FIGS. 4-5.

The operation of the accumulator unit 74 is illustrated in FIG. 20. Although the illustrated example utilizes four wellhead units 76, those skilled in the art will readily recognize how essentially the same process could be used with any number of wellhead units 76. The accumulator unit 74 begins with its initial setup at step 307. The lockouts are initially set to their open position at step 308, and the system idles at step 310. The system may exit the idle state to communicate with the wireline units 72 and wellhead units 76 at step 312, or for setting changes at step 314. The accumulator unit 74 will also exit the idle state in response to information from a wellhead unit 76 or wireline unit 72 at step 316. This information will be evaluated to determine whether the Bluetooth signal strength exceeds a predetermined threshold at step 318, indicating that the lubricator 34 is on a wellhead 14. If so, then a determination is made whether the amount of wireline that has been unwound from the reel exceeds a predetermined threshold at step 320. Exceeding this threshold indicates that wireline is within the wellhead. The appropriate lockout 88 is activated to resist movement of the valve control 90 at step 322. Whether the amount of unwound wireline continues to exceed the threshold is evaluated at step 324. The lockout remains activated until the threshold is no longer exceeded, and the lockout is then deactivated at step 326.

The present invention therefore provides a system for determining the depth of a wireline within a natural gas well or other well. The system will work with a variety of wells having different numbers and locations of valves. The sensors are easily installed on a well, as well as on a wireline, an accumulator, and a wireline lubricator. The system will work with variety of wireline reels without modification of the reel beyond attaching the proximity indicators and positioning the proximity sensors. The system will also work with a variety of presently existing accumulators having a variety of different lockout controls without modification of those controls beyond attaching the linear actuators. The system will also work with a variety of wireline reels without modification of those reels. The system will automatically lock out closure of that valve while the wireline is present within that valve unless the lock out is overridden due to an emergency, preventing unnecessary loss of the wireline as well as the need for expensive wireline recovery operations.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A lockout system for locking out valves on a wellhead when a wireline is present within a wellhead, the lockout system comprising:

a beacon structured to be secured to a wireline lubricator;

a wellhead unit structured to be secured to the wellhead, the wellhead unit being structured to detect the beacon when the wellhead unit is secured to the wellhead, the beacon is secured to the wireline lubricator, and the wireline lubricator is secured to the wellhead;

a wireline unit, the wireline unit being in communication with a sensor that is structured to detect rotation of a reel upon which wireline is wound;

a controller structured to receive communication from the wellhead unit and wireline unit, the controller having memory containing executable instructions to determine whether wireline is present within the wellhead; and an accumulator unit operatively connected to at least one actuator, the at least one actuator being structured to be operatively connected to a lockout for at least one valve on the wellhead, the accumulator unit having memory containing executable instructions to activate the at least one actuator to move a control for the lockout upon the controller determining that wireline is present within the wellhead or upon the controller determining that wireline is no longer within the wellhead.

2. The depth monitoring system according to claim 1, wherein:

the beacon emits a wireless signal; and the wellhead unit includes a receiver for the wireless signal.

3. The depth monitoring system according to claim 2, wherein:

the beacon emits a short wave radio frequency; and the receiver of the wellhead unit is a short wave radio frequency receiver.

4. The depth monitoring system according to claim 1:

further comprising at least two proximity indicators structured to be secured to the reel; and wherein the wireline unit is in communication with a pair of proximity sensors, each of the proximity sensors being structured to detect proximity to at least one of the at least two proximity indicators.

5. The depth monitoring system according to claim 4, wherein the proximity indicators are magnets.

6. The depth monitoring system according to claim 1, wherein each of the accumulator unit, wireline unit, and wellhead unit includes a wireless communication device.

7. The depth monitoring system according to claim 6 wherein each the wireless communication devices of the accumulator unit, wireline unit, and wellhead unit is a radio frequency communication device.

8. The depth monitoring system according to claim 1, wherein the at least one actuator is a linear actuator, the at least one linear actuator being structured to resist movement of a valve control for a wellhead upon activation of the linear actuator by the accumulator unit.

9. A method of locking out valves disposed on a wellhead, comprising:

providing a beacon secured to a wireline lubricator;

providing a wellhead unit secured to the wellhead;

providing a wireline unit;

providing a sensor in communication with the wireline unit;

providing an accumulator unit;

providing at least one actuator operatively connected to the accumulator unit, the at least one actuator also being operatively connected to a valve control for the valves disposed on the wellhead;

detecting the beacon using the wellhead unit when the wireline lubricator is secured to the wellhead;

detecting rotation of a reel upon which wireline is wound;

determining whether wireline is within the wellhead based on detection of the beacon and detection of rotation of the reel; and activating the at least one actuator to resist movement of the valve control upon determining that wireline is present within the wellhead.

10. The method according to claim 9, further comprising causing the at least one actuator to permit movement of the valve control upon determining that wireline is no longer within the wellhead.

* * * * *